US012326316B2

(12) United States Patent
Denton et al.

(10) Patent No.: US 12,326,316 B2
(45) Date of Patent: Jun. 10, 2025

(54) ACCESSORY SUPPORT FOR AN ARCHERY BOW AND RELATED APPARATUSES

(71) Applicant: Hoyt Archery, Inc., Salt Lake City, UT (US)

(72) Inventors: Douglas E. Denton, Stansbury Park, UT (US); Eric W. Eldred, North Salt Lake, UT (US)

(73) Assignee: Hoyt Archery, Inc., Salt Lake City, UT (US)

( * ) Notice: Subject to any disclaimer, the term of this patent is extended or adjusted under 35 U.S.C. 154(b) by 98 days.

(21) Appl. No.: 18/128,626

(22) Filed: Mar. 30, 2023

(65) Prior Publication Data

US 2024/0328745 A1 Oct. 3, 2024

(51) Int. Cl.
*F41B 5/14* (2006.01)

(52) U.S. Cl.
CPC ..... *F41B 5/1403* (2013.01); *F41B 5/1453* (2013.01)

(58) Field of Classification Search
CPC ..... F41B 5/1403; F41B 5/1453; F41A 23/10
See application file for complete search history.

(56) References Cited

U.S. PATENT DOCUMENTS 5,106,044 A * 4/1992 Regard, III ..... F41B 5/14 248/169
5,592,929 A * 1/1997 Hoyt, Jr. ..... F41B 5/0005 124/88
6,957,648 B1 * 10/2005 Adcock ..... F41B 5/1426 124/89
7,036,497 B2 5/2006 Horn
9,255,751 B1 * 2/2016 Beltz ..... F41A 23/10
9,568,270 B1 * 2/2017 LoRocco ..... F41B 5/1453
9,803,950 B1 * 10/2017 Khoshnood ..... F41A 23/08
2004/0129497 A1 * 7/2004 Weiss ..... E06C 1/39 182/163
2005/0150484 A1 * 7/2005 Horn ..... F41B 5/14 248/176.1
2008/0006747 A1 * 1/2008 Bobro ..... F41A 23/10 248/178.1
2014/0060514 A1 * 3/2014 Bidigare ..... F41B 5/1426 124/88
2016/0054090 A1 * 2/2016 Nettleton ..... F41B 5/1453 124/86
2017/0205180 A1 * 7/2017 Ding ..... F16M 11/247
2019/0033032 A1 * 1/2019 Hunter ..... F41B 5/0094
2019/0257614 A1 * 8/2019 Bofill ..... F41C 23/16
(Continued)

OTHER PUBLICATIONS

"Go-Stix Bow Stand," webpage <https://store.hoyt.com/products/go-stix-bow-stand>, 1 page, Apr. 13, 2023.

*Primary Examiner* — John E Simms, Jr.

(57) ABSTRACT

A support for retaining an archery bow on a support surface includes a mounting block affixable to the archery bow and a member adjustably coupled to the mounting block. The member can be repositionable between two or more configurations relative to the mounting block. For example, the member can be rotatable between two or more orientations relative to the mounting block. In some examples, the member can be linearly repositionable relative to the mounting block. In some examples, the member can be a first member and the support can further include a second member adjustably coupled to the mounting block.

3 Claims, 26 Drawing Sheets

(56) References Cited

U.S. PATENT DOCUMENTS

| | | | | |
|---|---|---|---|---|
| 2022/0018628 | A1* | 1/2022 | Coalson | F41B 5/1453 |
| 2022/0049923 | A1* | 2/2022 | Popa | F41B 5/1453 |
| 2022/0155038 | A1* | 5/2022 | Leis | F41B 5/1453 |
| 2023/0139525 | A1* | 5/2023 | Stocks | F41B 5/1453<br>124/23.1 |
| 2023/0383896 | A1* | 11/2023 | Davidson | F16M 11/041 |

* cited by examiner

ACCESSORY SUPPORT FOR AN ARCHERY BOW AND RELATED APPARATUSES

TECHNICAL FIELD

The present disclosure generally relates to archery equipment and specifically relates to incorporating an accessory stand or support structure onto an archery bow.

BACKGROUND

Archery equipment, such as recurve bows, crossbows, and compound bows, are regularly used to launch arrows and other projectiles down range at one or more targets. Components of the archery bow work in unison to provide accurate and repeatable arrow flight while also providing a desirable user experience (e.g., satisfactory vibration and sound characteristics). Archery accessories, such as a sight, can be affixed to the archery bow to increase utility and directly impact user satisfaction. Components and accessories for archery bows can be improved to advantageously impact an archer's shooting experience, performance, and overall satisfaction with the archery equipment.

SUMMARY

One aspect of the present disclosure relates to a support for an archery bow including a mounting block and a member. The member has a proximal end and a distal end. The proximal end is coupled to the mounting block. The member is repositionable between two or more configurations relative to the mounting block.

In some examples, the member can be rotatable between the two or more configurations relative to the mounting block. The member can be coupled to the mounting block by a fastener defining an axis of rotation about which the member is rotatable. In some examples, the two or more configurations include a first configuration and a second configuration. The member can be in a first orientation relative to the mounting block when in the first configuration. The member can be in a second orientation relative to the mounting block when in the second configuration. In some examples, the two or more configurations can include a first configuration and a second configuration. The member can be in a first position relative to the mounting block when in the first configuration and in a second position relative to the mounting block when in the second configuration. The first position can be linearly offset relative to the second position.

In some examples, the member can be a first member and the support can further include a second member coupled to the mounting block. The second member can be repositionable between two or more configurations relative to the mounting block. In some examples, the first member and the second member can be independently repositionable between the respective two or more configurations. In some examples, the first member and the second member define an angle and a size of the angle can be dependent on the respective configurations of the first member and the second member relative to the mounting block.

In some examples, the member can be coupled to the mounting block by a dovetail engagement or picatinny engagement. In some examples, the support can further include a detent spring assembly disposed between the mounting block and the member. In some examples, the mounting block can include an engaging feature configured to engage with the archery bow to orient the mounting block relative to the archery bow. In some examples, a total length of the member can be adjustable from a first length to a second length.

Another aspect of the disclosure relates to a support for an archery bow including a mounting block and a member. The member has a proximal end and a distal end. The proximal end is coupled to the mounting block. The distal end is configured to contact a support surface at a distance of at least 3.75 inches from a center plane of the mounting block. The distance extends parallel to the support surface and perpendicular to the center plane.

In some examples, a length of the member is at least 6.25 inches. The center plane can extend through a centroid of the mounting block. The member can be a first member and the support can further include a second member coupled to the mounting block. The distance can be a first distance and the second member can be configured to contact the support surface at a second distance of at least 3.75 inches from the center plane of the mounting block. The second distance can extend parallel to the support surface and perpendicular to the center plane. A third distance between the distal end of the first member and a distal end of the second member can be at least 7.5 inches.

Yet another aspect of the present disclosure relates to a support for an archery bow including a mounting block and a member. The mounting block includes an engaging feature orienting the mounting block relative to the archery bow. The member has a proximal end and a distal end. The proximal end is coupled to the mounting block. The distal end is configured to contact a support surface.

In some examples, the engaging feature can define a cavity configured to receive a protrusion extending from a riser of the archery bow. In some examples, the engaging feature can form a protrusion configured to extend into a cavity formed within a riser of the archery bow. In some examples, the member can be a first member and the support can further include a second member coupled to the mounting block. The first member can be configured to contact the support surface at a first contact point. The second member can be configured to contact the support surface at a second contact point. A first axis can extend through the first contact point and the second contact point. The engaging feature can orient the mounting block relative to the archery bow such that the first axis is substantially perpendicular to a second axis defined by a portion of a bow string of the archery bow extending between respective cams of the archery bow.

The above summary of the present invention is not intended to describe each embodiment or every implementation of the present invention. The Figures and the detailed description that follow more particularly exemplify one or more preferred embodiments.

BRIEF DESCRIPTION OF THE DRAWINGS

The accompanying drawings and figures illustrate a number of exemplary embodiments and are part of the specification. Together with the present description, these drawings demonstrate and explain various principles of this disclosure. A further understanding of the nature and advantages of the present invention may be realized by reference to the following drawings. In the appended figures, similar components or features may have the same reference label.

Figure 1A:
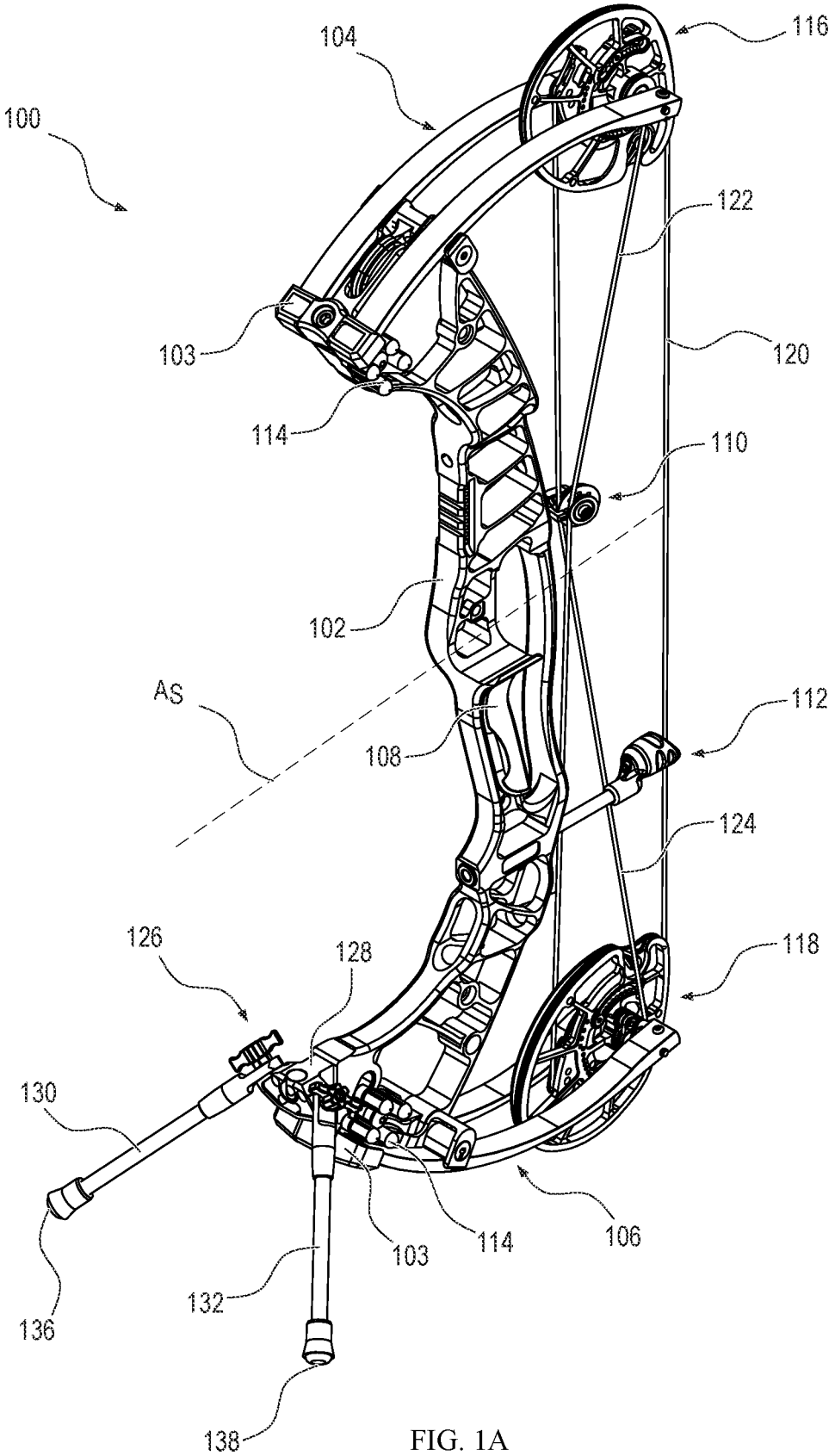
FIG. 1A is a perspective side view of an archery bow, according to some embodiments.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

While waiting to launch arrows, taking a break, or awaiting wild game to walk across the archers' path, the archer may desire to temporarily place their archery bow in a position that is conducive for retrieving the archery bow for further operation. For example, the archer may set the bow on the ground or another support surface while retrieving arrows previously launched at respective targets. Advancements in technologies that allow an archer to reliably and securely rest archery bows of various shapes and sizes in an upright position on a support surface is needed.

One aspect of the present disclosure generally relates to a support removably coupled to a compound archery bow which enables an archer to set the archery bow upright on a support surface. In some examples, the support can include a mounting block and one or more members extending from the mounting block which are repositionable relative to the mounting block between two or more positions. For example, a user or archer can adjust one or more members relative to the mounting block to set the one or more members in a position that is conducive to supporting the bow upright on the support surface. In some examples, each of the one or more members can be linearly adjustable relative to the mounting block (e.g., slidable or repositionable on the mounting block at two or more positions that are linearly offset from one another). In some examples, each of the one or more members can be rotatable relative to the mounting block (e.g., pivotable or angularly adjustable on the mounting block at two or more angular positions relative to the mounting block).

In some examples, respective distal ends of the one or more members can form or define feet that engage or contact the support surface while the archery bow is placed upright on the support surface. While placed vertically upright on the support surface, an upper cam assembly of the archery bow can be displaced further from the support surface than a lower cam assembly of the archery bow. In other words, the upper cam assembly can be disposed at a higher elevation relative to the support surface than the lower cam assembly. While placed horizontally upright on the support surface, upper and lowers cam assemblies of the archery bow can be substantially equidistant from the support surface such that a riser of the archery bow is disposed between the bowstring and the support surface.

In another aspect of the present disclosure, a member of the support can include a proximal end and a distal end. The proximal end can be coupled to the mounting block. The distal end can contact the support surface at a distance of at least 3.75 inches from a center plane of the mounting block. The distance can extend parallel to the support surface and perpendicular to the center plane. The center plane can extend through a centroid of the mounting block and substantially parallel to an axis defined by a bow string of the archery bow. For example, the support can include first and second members coupled to the mounting block on different sides of the center plane. Each of the first and second members can contact the support surface at a distance of at least 3.75 inches from the center plane to define a width between the respective contacts of at least 7.5 inches. While standing upright on a support surface, the archery bow can experience lateral forces that induce moments biasing the archery bow to fall or tip over. As will be described herein, a threshold distance of 3.75 inches between a contact point of the member and the center plane of the mounting block can better withstand lateral forces and thereby retain the archery bow in an upright static stance on the support surface.

In another aspect of the present disclosure, the mounting block can include an engaging feature that orients the mounting block relative to the archery bow. For example, the mounting block and a riser of the archery bow can define a male-female interlocking structure that prevents the mounting block from rotating while the mounting block is coupled to the archery bow. The engaging feature can orient the mounting block relative to the archery bow such that the respective distal ends of the one or more members are positioned to contact the support surface while the archery bow is set down in an upright position. For example, the support can include first and second members having respective distal ends which contact the support surface. The respective contact points of the distal ends can define an axis that is substantially perpendicular to an axis defined by a portion of the bow string disposed between upper and lower cam assemblies of the archery bow.

The present description provides examples, and is not limiting of the scope, applicability, or configuration set forth in the claims. Thus, it will be understood that changes may be made in the function and arrangement of the supports and/or other elements of the archery bow discussed without departing from the spirit and scope of the disclosure, and various embodiments may omit, substitute, or add other procedures or components as appropriate. For instance, features described with respect to certain embodiments may be combined in other embodiments. The specific examples shown in the figures and described herein should not, therefore, be considered to limit the breadth of possible embodiments and combinations of possible embodiments contemplated by the present disclosure.

Referring now to the figures in detail, FIG. 1A shows a compound archery bow 100. The archery bow 100 is at a rest position (e.g., a brace state or brace position). The archery bow 100 can comprise a riser 102 from which one or more upper limbs 104 and one or more lower limbs 106 extend. For example, the upper limbs 104 can be affixed to the riser 102 by one or more limb pockets 103. The archery bow 100 can include a handle portion or grip 108, a roller guard or cable guard 110, a string-stop damper 112, dampers 114, and other components.

The upper limbs 104 may be connected to an upper cam assembly 116, and the lower limbs 106 may be connected to a lower cam assembly 118. A bowstring 120 (i.e., draw string) may extend across the length of the archery bow 100 between the upper cam assembly 116 and the lower cam assembly 118. The terminal ends of the bowstring 120 may be attached to and held entrained to the cam assemblies 116, 118, at least in the brace position, and the limbs 104, 106 may be flexed to store energy and retain tension in the bowstring 120. A first cable 122 and a second cable 124 may also be attached to and extend between the upper cam assembly 116 and the lower cam assembly 118. Collectively, the first cable 122 and the second cable 124 may be referred to herein as the cables of the archery bow 100. The first and second cables 122, 124 may retain tension in the limbs 104, 106 and cam assemblies 116, 118 and may be controlled to adjust tension in the bowstring 120.

The figures illustrate example archery apparatuses that may be used in conjunction with the principles and teachings of the present disclosure. Thus, while the archery bows described herein are compound bows, it will be understood by those having ordinary skill in the art that the components of the archery bow, accessories, and related methods and apparatuses included in embodiments of the present disclosure may be applied to components and apparatuses in compound bows, recurve bows, crossbows, their accessories, and other equipment related to archery. Similarly, archery equipment applying the teachings of the present disclosure does not need to implement all of the features of the present disclosure. For example, in some embodiments, the archery bow may not comprise a cable guard 110 or a string-stop damper 112, so features associated with those accessories may be omitted from the archery bow 100.

When shooting an arrow, the tail end of the arrow may be nocked with the bowstring 120 at a nocking point (not shown) while the archery bow 100 is in the brace position shown in FIG. 1A. The bowstring 120 may be drawn rearward to a full draw position, thereby partially unraveling the bowstring 120 from the outer grooves of the cam assemblies 116, 118. The archer may grasp the grip 108 of the riser 102 and draw back the bowstring 120 (e.g., by using a D-loop, not shown). As the limbs 104, 106 flex inward and the cables 122, 124 wind around the cam assemblies 116, 118, the cables 122, 124 may slide along or may be in rolling contact with portions of the cable guard 110, which may comprise at least one roller or other smooth support in contact with the cables 122, 124 where they contact the cable guard 110.

When the bowstring 120 is released, the potential/stored energy in the limbs 104, 106 is released, and the bowstring 120 quickly accelerates back toward the brace position (shown in FIG. 1A) as it applies a shooting force to an end of the projectile (e.g., an arrow). As the limbs 104, 106 release their energy, the cam assemblies 116, 118 are spread apart, and the terminal ends of the bowstring 120 wrap around the cam assemblies 116, 118, and the cables 122, 124 unwind from the cam assemblies 116, 118. A portion of the bowstring 120 may contact the string-stop damper 112, which can help dampen vibrations in the bowstring 120, and the cables 122, 124 may roll or slide against the cable guard 110 as the cam assemblies 116, 118 move.

In some examples, the archery bow 100 can include a support 126 having a mounting block 128, a first member 130, and a second member 132. The support 126 can contact a support surface (see FIG. 1B) when the archery bow 100 is placed upright on the support surface, such that the archery bow 100 remains in a static or standing position on the support surface without requiring a user (e.g., an archer) to maintain physical contact with the archery bow 100. In some examples, the archery bow 100 can be considered vertically upright on the support surface when the upper cam assembly 116 is displaced further from the support surface than the lower cam assembly 118. In some examples, the archery bow 100 can be considered horizontally upright on the support surface when the riser 108 is disposed between the bowstring 120 and the support surface. Each of the first and second members 130, 132 can have proximal ends affixed to the mounting block 128. The support 126 can remain affixed to the archery bow 100 while the archer is operating the archery bow (e.g., launching projectiles) or can otherwise be coupled to the archery bow 100 before the archer sets the archery bow 100 down on the support surface, for example, to leave the archery bow 100 in a vertically upright or standing position on the support surface while the archer fetches or retrieves previously launched arrows.

Figure 1B:
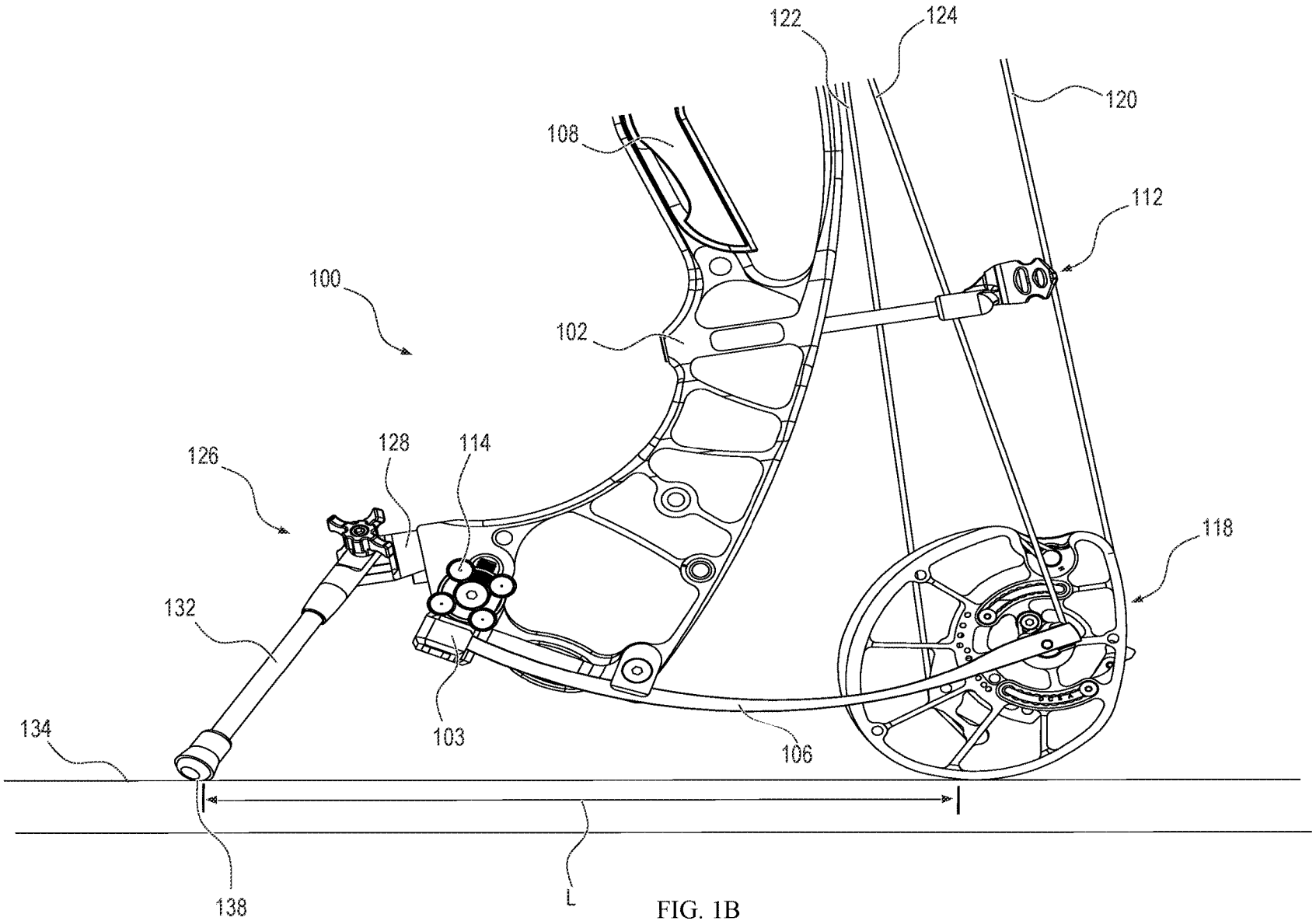
FIG. 1B is a detail side view of the archery bow on a support surface, according to some embodiments.
Figure 1C:
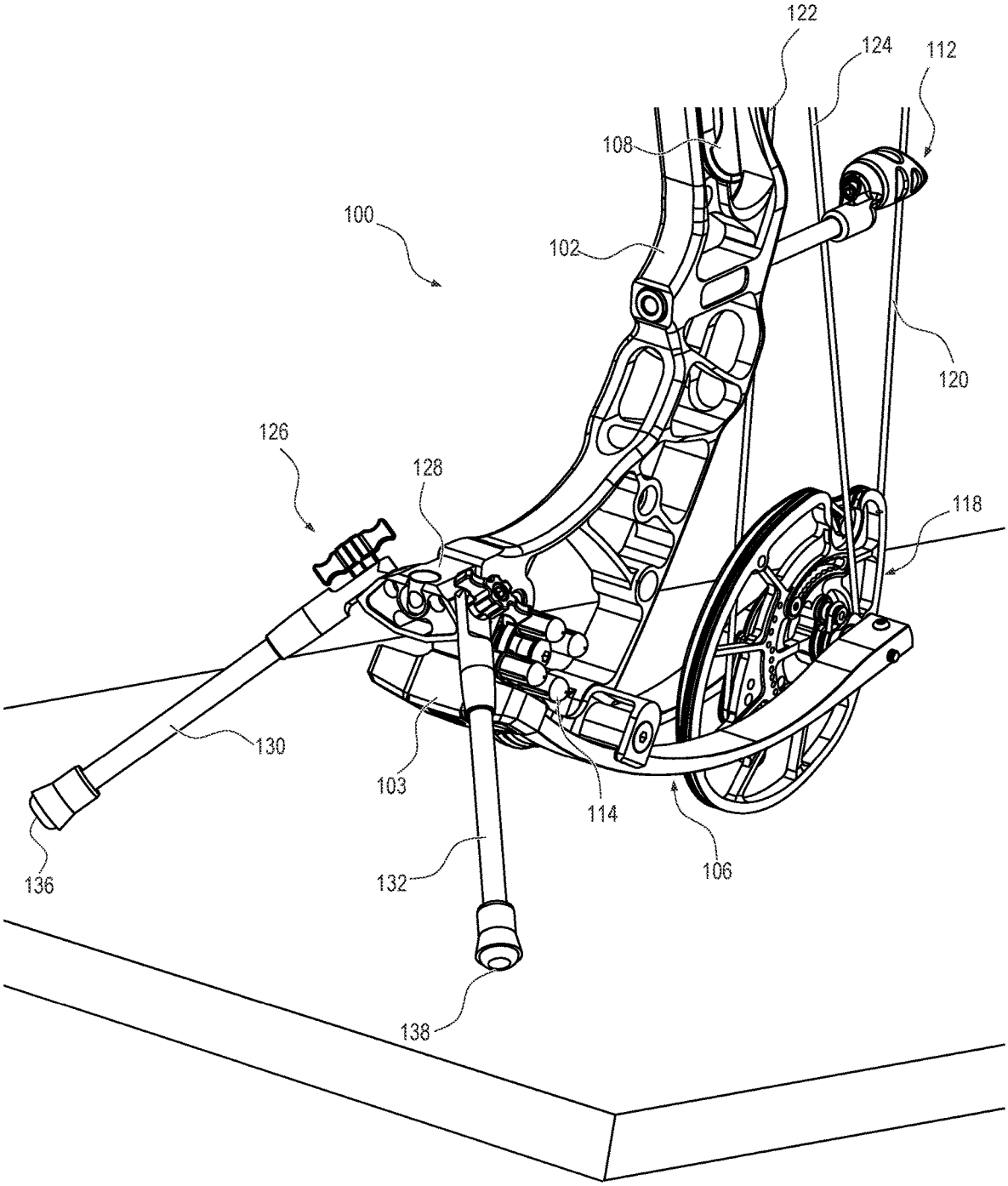
FIG. 1C is a detail perspective side view of the archery bow on the support surface, according to some embodiments.

As shown in FIG. 1B and FIG. 1C, the archery bow 100 can be positioned vertically upright on a support surface 134 using the support 126. Each member (e.g., first and second members 130, 132) can extend from the mounting block 128 and contact the support surface 134 to form a respective contact point (e.g., contact points 136, 138) between the support 126 and the support surface 134. For example, respective proximal ends of the first and second members 130, 132 can be adjustably coupled to the mounting block 128 and respective distal ends of the first and second members 130, 132 can contact the support surface 134. In some examples, one or more components of the archery bow 100 can additionally contact the support surface 134. For example, the lower cam assembly 118 can contact the support surface 134 when the archery bow 100 is placed vertically upright on the support surface 134. A combination of contact points formed by the support 126 and the archery bow 100 can engage the support surface 134 to retain the archery bow 100 in a static and vertically upright state. In some examples, a support can be used to position the archery bow 100 on the support surface 134 in a static and horizontally upright state (see FIGS. 8A and 8B).

Figure 2A:
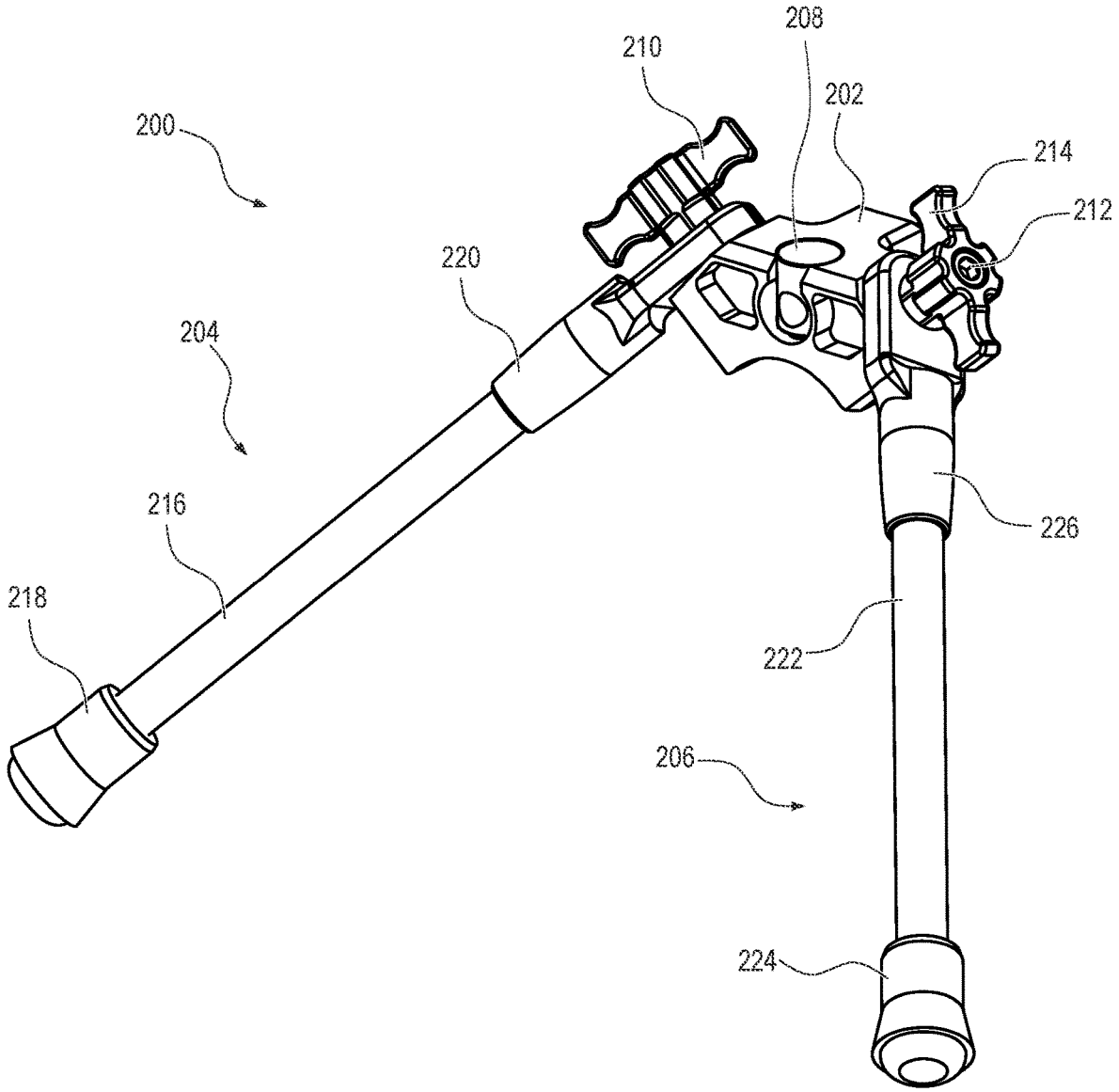
FIG. 2A is a perspective side view of a support for an archery bow, according to some embodiments.
Figure 2B:
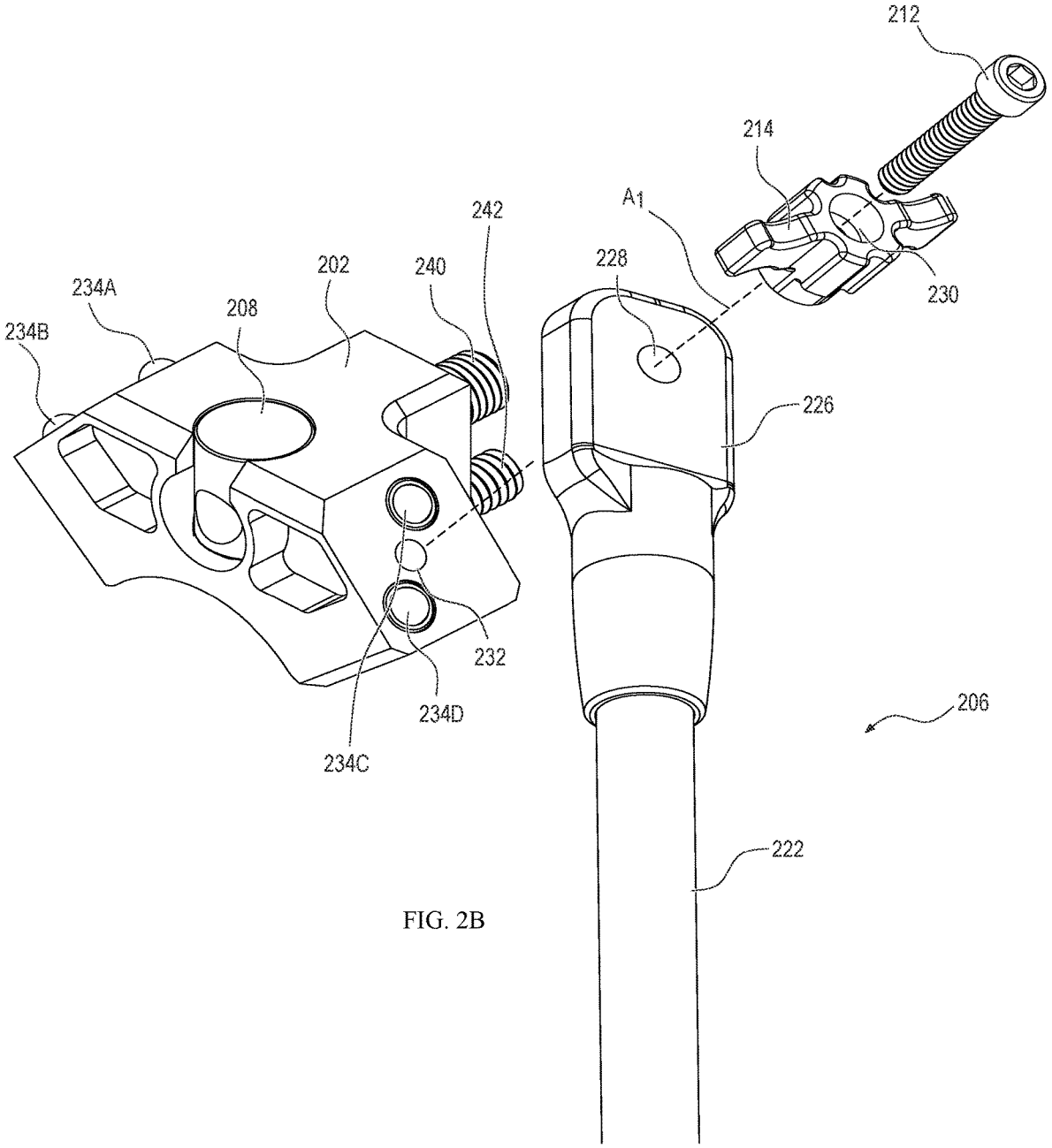
FIG. 2B is an exploded perspective side view of the support, according to some embodiments.
Figure 2C:
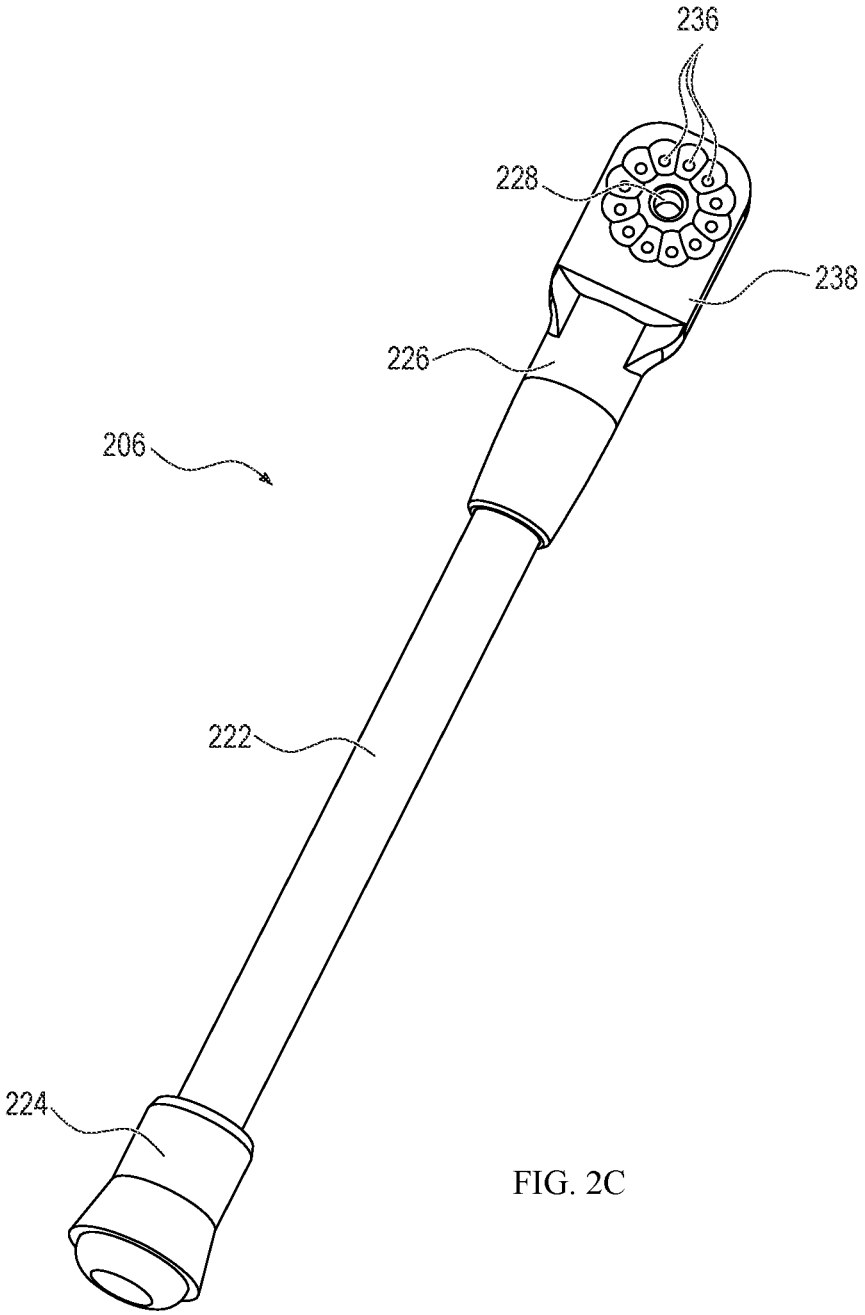
FIG. 2C is a perspective side view of a member of the support, according to some embodiments.
Figure 2D:
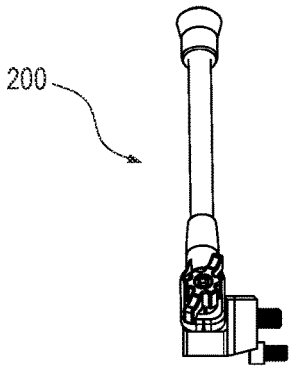
FIG. 2D is a side view of the support in a first configuration, according to some embodiments.
Figure 2E:
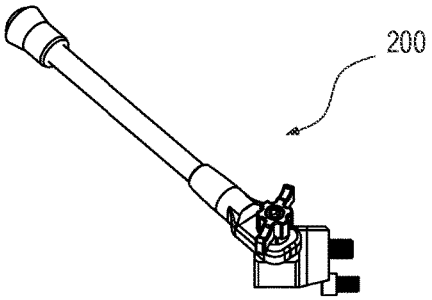
FIG. 2E is a side view of the support in a second configuration, according to some embodiments.
Figure 2F:
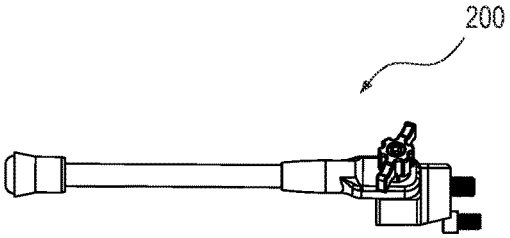
FIG. 2F is a side view of the support in a third configuration, according to some embodiments.
Figure 2G:
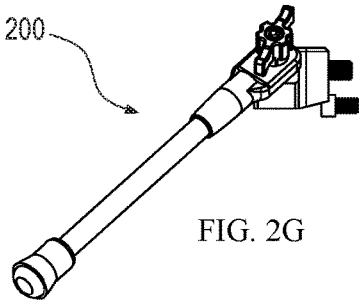
FIG. 2G is a side view of the support in a fourth configuration, according to some embodiments.
Figure 2H:
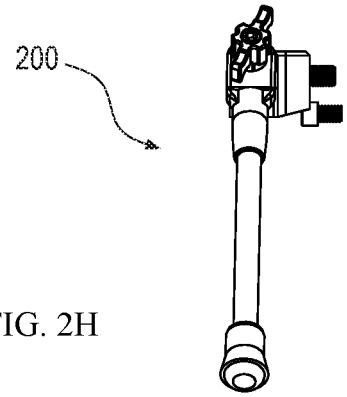
FIG. 2H is a side view of the support in a fifth configuration, according to some embodiments.
Figure 2I:
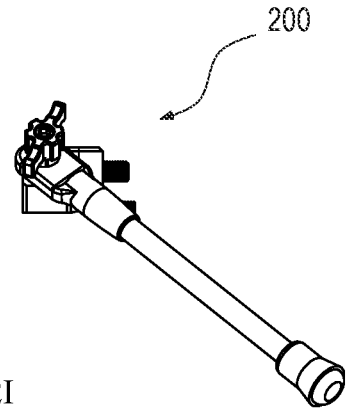
FIG. 2I is a side view of the support in a sixth configuration, according to some embodiments.
Figure 2J:
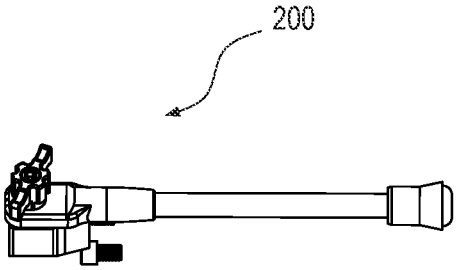
FIG. 2J is a side view of the support in a seventh configuration, according to some embodiments.
Figure 2K:
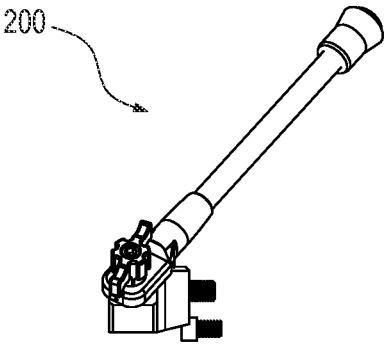
FIG. 2K is a side view of the support in a eighth configuration, according to some embodiments.
Figure 2L:
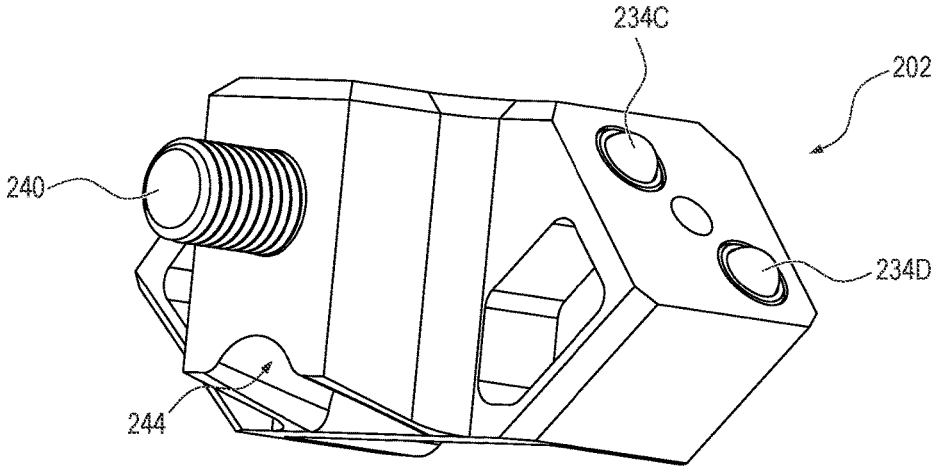
FIG. 2L is a perspective rear view a mounting block of the support, according to some embodiments.
Figure 2M:
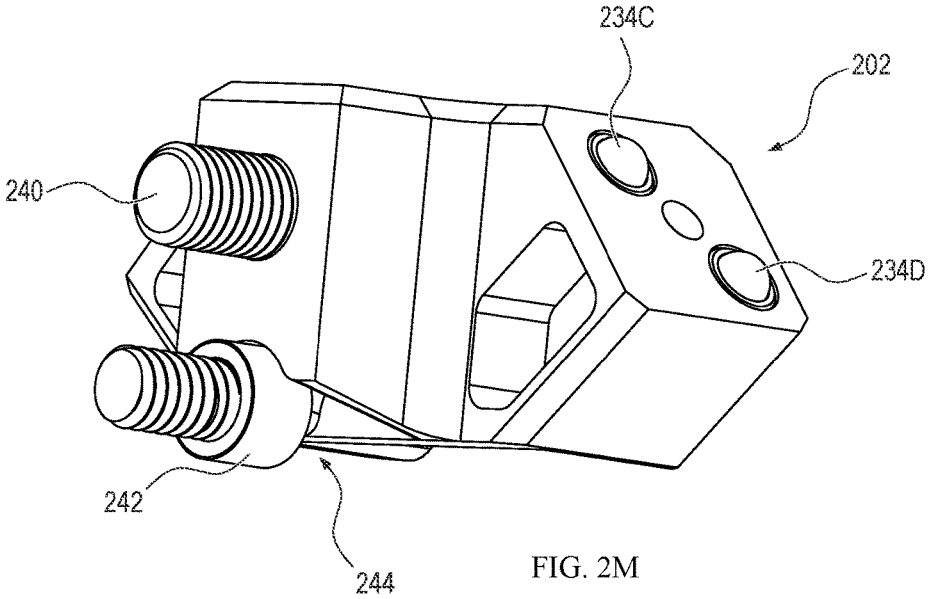
FIG. 2M is a perspective rear view the mounting block of the support, according to some embodiments.
Figure 2N:
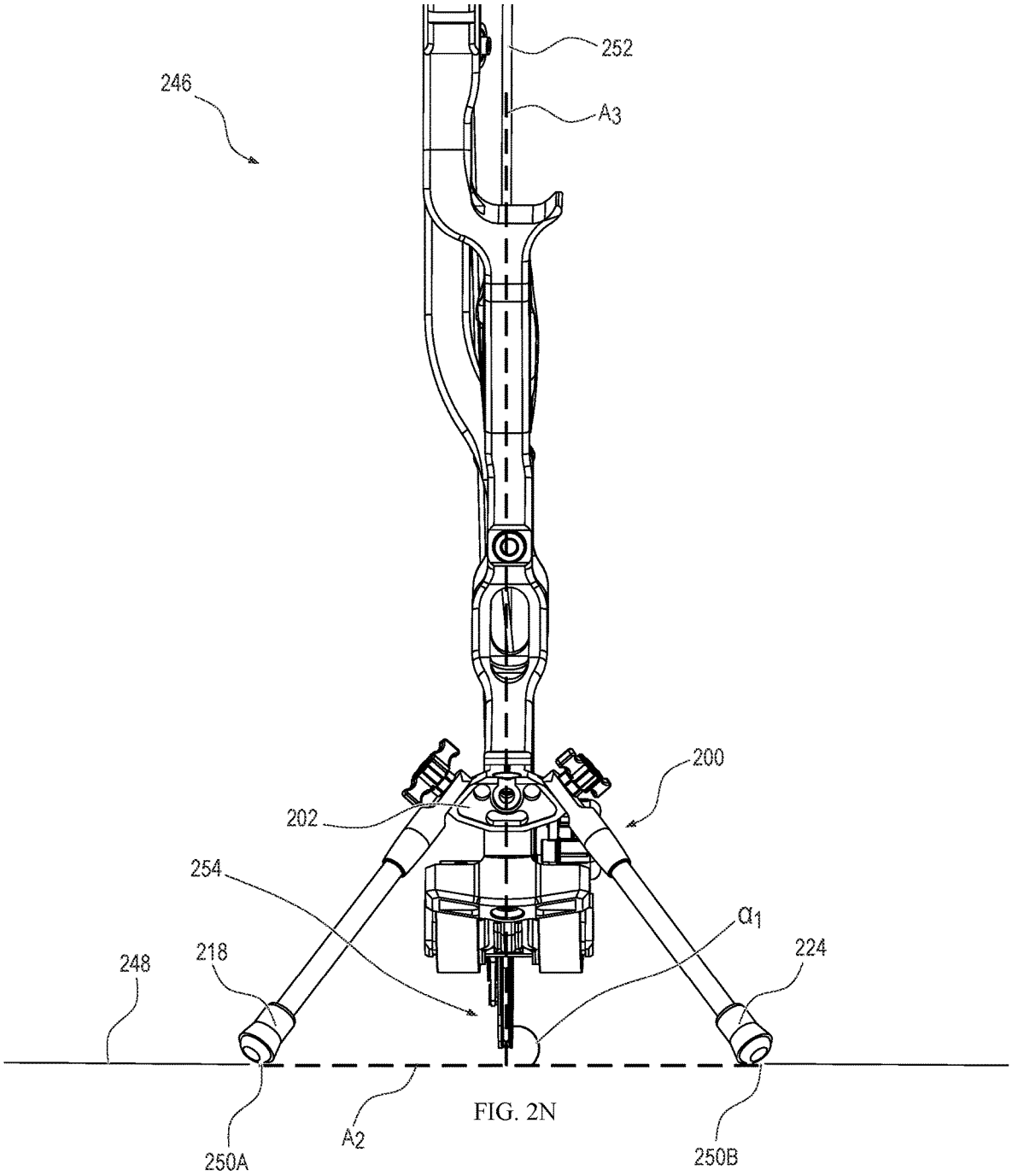
FIG. 2N is a front view an archery bow, according to some embodiments.

In some examples, the first and second members 130, 132 can be adjustable to vary a length L extending between the contact points 136, 138 (or an axis extending between the contact points, see axis $A_2$ at FIG. 2N) and one or more contact points formed by the archery bow (e.g., a contact point formed by the lower cam assembly 118). By adjusting the first and second members 130, 132 (linearly and/or rotatably) relative to the mounting block 128, the length L can be varied to accommodate a multitude of use cases and use conditions. For example, the length L may need to be relatively larger to support a particular archery bow on a support surface and relatively smaller to support a different archery bow on a support surface.

Figure 1D:
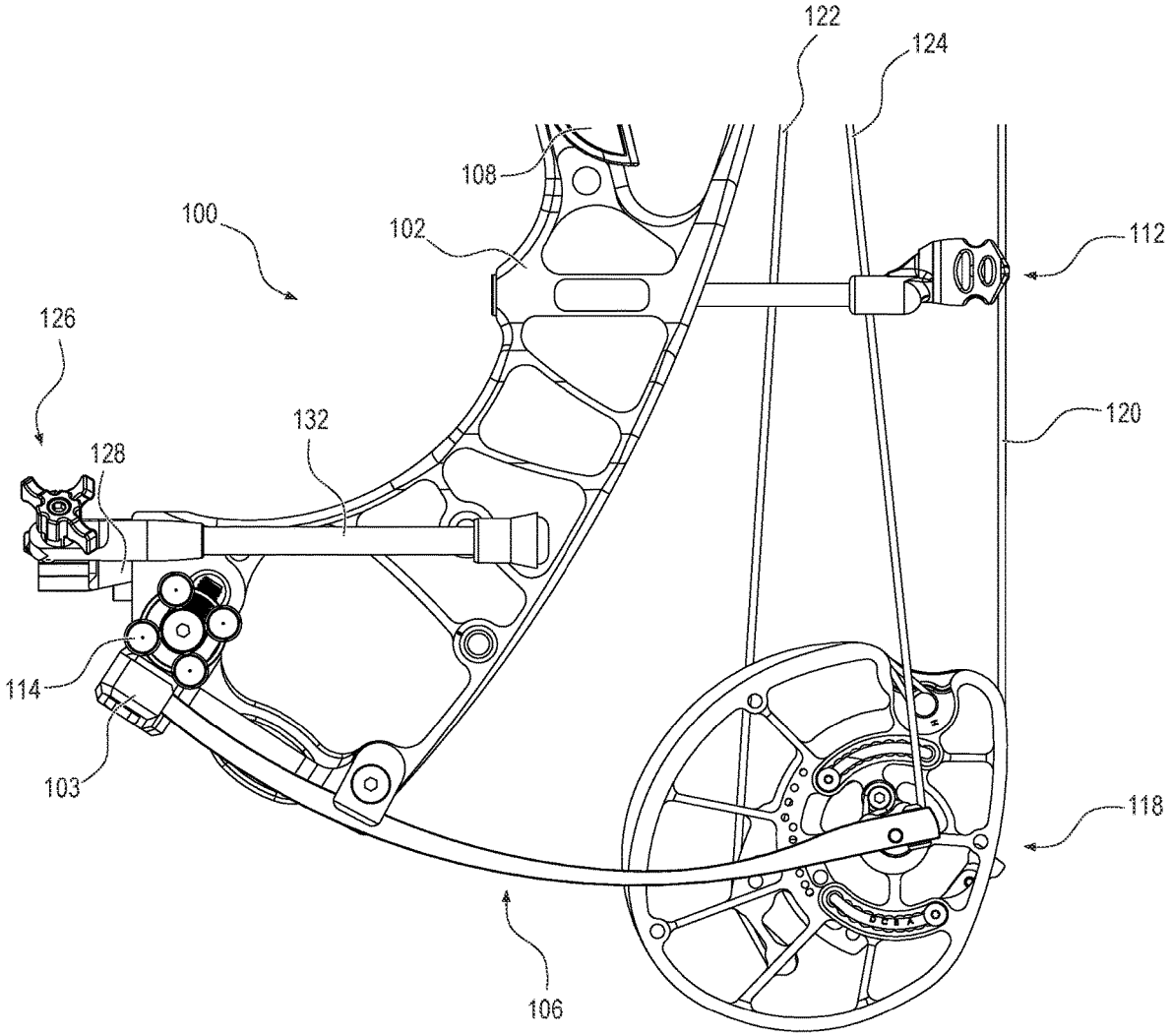
FIG. 1D is a detail side view of the archery bow, according to some embodiments.
Figure 1E:
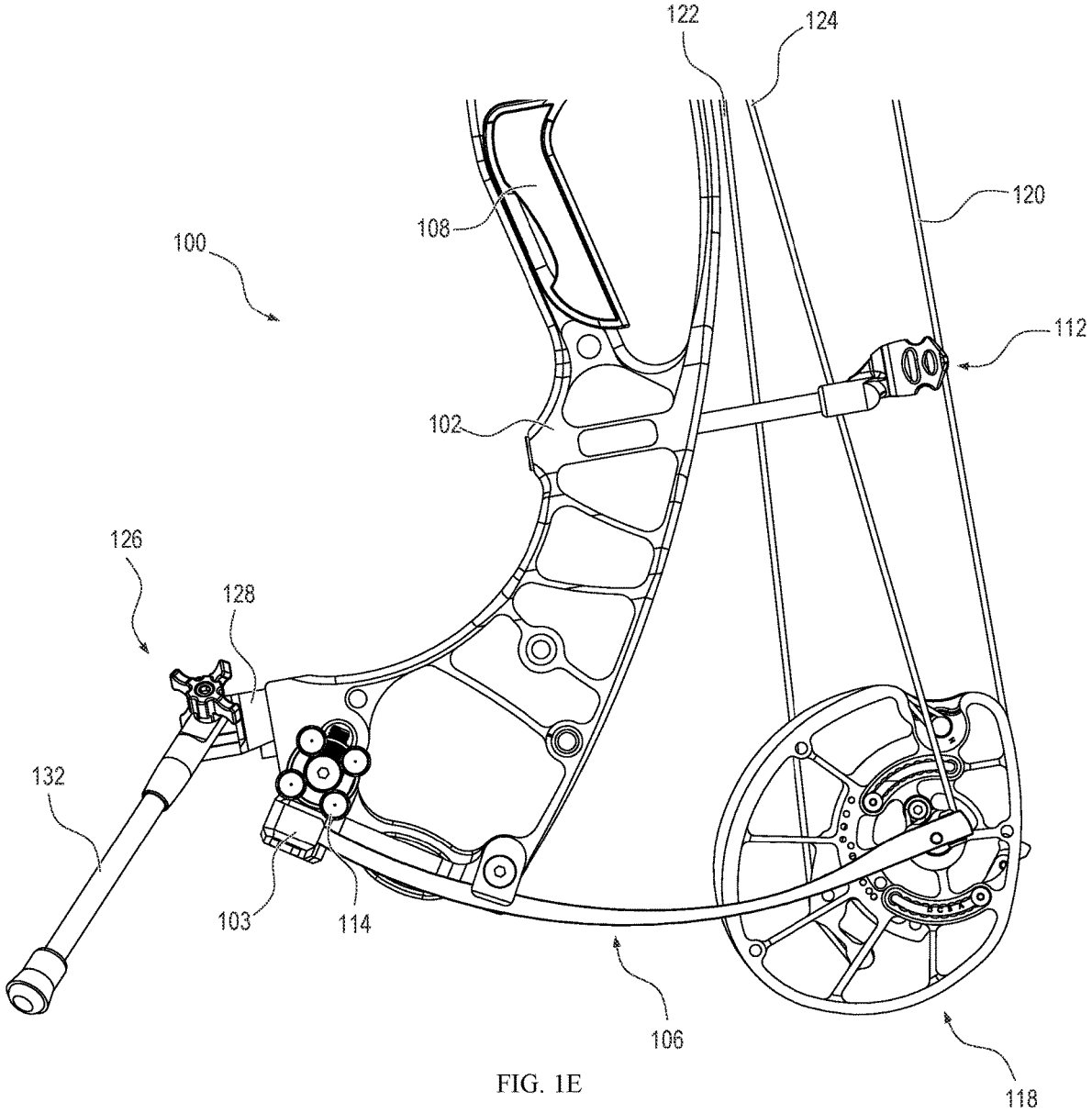
FIG. 1E is a detail side view of the archery bow, according to some embodiments.
Figure 1F:
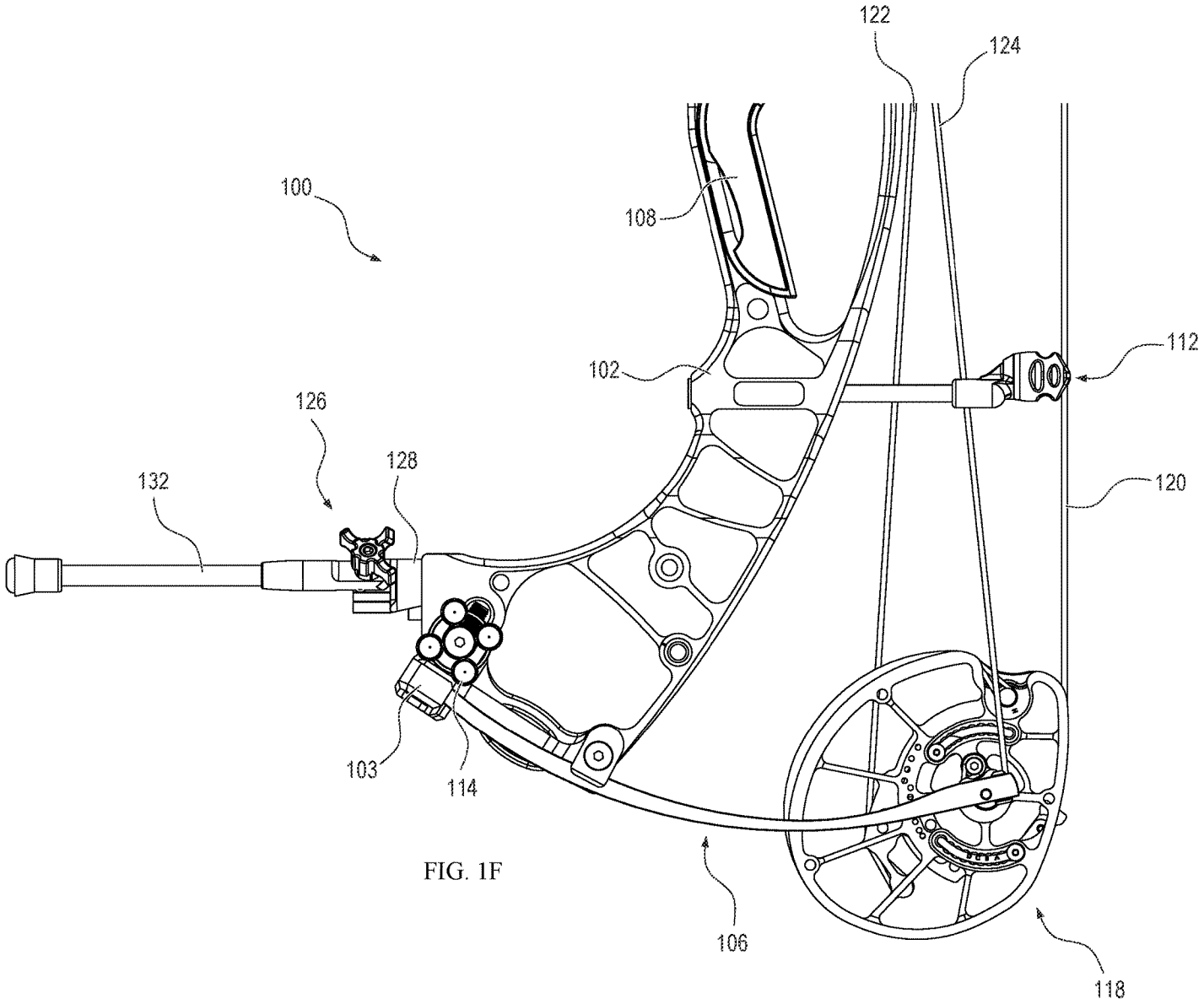
FIG. 1F is a detail side view of the archery bow, according to some embodiments.

As shown in FIGS. 1D-1F, in some examples, one or more of the first and second members 130, 132 can be adjustable relative to the mounting block 128. For example, the first and/or second member 130, 132 can be in a first angular position (i.e. orientation) relative to the mounting block 128 in a first configuration (see FIG. 1D). In a second configuration (see FIG. 1E), the first and/or second member 130, 132 can be in a second angular position (i.e. orientation) relative to the mounting block 128. In a third configuration (see FIG. 1F), the first and/or second member 130, 132 can be in a third angular position (i.e. orientation) relative to the mounting block 128.

In some examples, a length of each of the first and second members 130, 132 can be the same. In some examples, a length of each of the first and second members 130, 132 can be dissimilar such that one of the first and second members 130, 132 is longer than the other. In some examples, a length of each of the first and second members 130, 132 can be less than about 6.25 inches, at least about 6.25 inches, between about 6.25 inches and about 7.25 inches, between about 7.25 inches and about 8.25 inches, between about 8.25 inches and about 9.25 inches, or greater than 9.25 inches.

A support 126 having adjustable members 130, 132 can be beneficial for orienting the members 130, 132 to optimally support the archery bow 100 on the support surface 134. For example, an a support 126 capable of adjustment could be reconfigurable to accommodate a spectrum of terrain conditions (e.g., grassy, rocky, slanted, etc.) for archery bows of various sizes, weights, and other physical dissimilar characteristics. In some examples, each of the one or more members 130, 132 can include one or more components that support total length adjustment. For example, one or more of the members 130, 132 can adjust telescopically to enable a total length of the respective member to be adjusted to better retain the archery bow 100 on a slanted support surface 134. Additionally, or alternatively, a support 126 having adjustable members 130, 132 can be beneficial for orienting the members 130, 132 to enable the archery bow 100 to fit within a carrying case or otherwise reduce a periphery of the archery bow 100 (e.g., a side profile of the archery bow 100 with the support 126 coupled thereto). In some examples, one or more of the members 130, 132 can be additionally, or alternatively, adjustable along a longitudinal axis (i.e., a length-wise adjustment) from a first length to a second length. For example, one or more of the members 130, 132 can be telescopic by nesting tubes having various diameters within one another.

While the support 126 is shown and described herein having first and second members 130, 132, the support 126 can utilize a single member in some examples or more than two members in some examples. For example, the support 126 can have a singular member which extends from the mounting block 128 and branches or forks along the length of the member to form or define multiple contact points (e.g., contact points 136, 138). As such, the specific examples shown in the figures and described herein should not be considered to limit the breadth of possible embodiments and combinations of possible embodiments contemplated by the present disclosure. The support 126 and corresponding features of the support 126 relating to adjustability will be described in further detail herein with reference to FIGS. 2A-2O.

FIG. 2A shows a support 200 for an archery bow including a mounting block 202, a first member 204, a second member 206, and a dowel or barrel nut 208. In some examples, the support 200 can include the barrel nut 208 enabling a user to removably couple an accessory (e.g., a stabilizer) to the support 200 while also enabling accessibility to a fastener 240 (see FIG. 2B) disposed within the mounting block 202 that engages with the archery bow (e.g., archery bow 100) to retain the support 200 to the archery bow.

While the support 200 is shown in FIG. 2A with two members (i.e., first and second members 204, 206), the support 200 can have more than two members in other embodiments without departing from the teachings of the present disclosure. The first member 204 is rotatably coupled to the mounting block 202 such that an angular position or orientation of the first member 204 relative to the mounting block 202 can be adjustable. For example, the first member 204 can be releasably retained to the mounting block 202 by a fastener (not shown) defining an axis of rotation the first member 204 can rotate about. In some examples, the support 200 can include a first knob 210 coupled to the first member 204 and the mounting block 202 via the fastener. The first knob 210 can be loosened or rotated to loosen an engagement between the mounting block 202 and the first member 204 to enable rotation of the first member 204 relative to the mounting block 202. When the first member 204 is oriented at a desired angular position relative to the mounting block 202, the first knob 210 can be rotated to tighten the engagement between the mounting block 202 and the first member 204 to retain the first member 204 in the desired orientation. In some examples, the first knob 210 can include one or more features, such as flanges or wings, to facilitate rotation of the first knob 210 by a user/archer.

In some examples, the second member 206 is rotatably coupled to the mounting block 202 such that an angular position or orientation of the second member 206 relative to the mounting block 202 can be adjustable. For example, the second member 206 can be releasably retained to the mounting block 202 by a fastener 212 defining an axis of rotation $A_1$ the second member 206 can rotate about. In some examples, the support 200 can include a second knob 214 coupled to the second member 206 and the mounting block 202 via the fastener 212. The second knob 214 can be loosened or rotated to loosen an engagement between the mounting block 202 and the second member 206 to enable rotation of the second member 206 relative to the mounting block 202. When the second member 206 is oriented at a desired angular position relative to the mounting block 202, the second knob 214 can be rotated to tighten the engagement between the mounting block 202 and the second member 206 to retain the second member 206 in the desired orientation. In some examples, the second knob 214 can include one or more features, such as flanges or wings, to facilitate rotation of the second knob 214 by a user/archer.

In some examples, each of the first and second members 204, 206 can include one or more discrete components that are assembled to form the first or second member 204, 206. For example, as shown in FIG. 2A, the first member 204 can include a first extension 216 coupled between a first foot 218 and a first bushing 220. The first bushing 220 can form or define a proximal end of the first member 204 and the first foot 218 can define a distal end of the first member 204. In some examples, the first foot 218 and the first bushing 220 can be adhered, fastened, welded, or otherwise coupled to opposing ends of the first extension 216. Additionally, or alternatively, the second member 206 can include a second extension 222 coupled between a second foot 224 and a second bushing 226. The second bushing 226 can form or define a proximal end of the second member 206 and the second foot 224 can define a distal end of the second member 206. In some examples, the second foot 224 and the second bushing 226 can be adhered, fastened, welded, or otherwise coupled to opposing ends of the second extension 222. While the first and second members 204, 206 are shown as having discrete components, in other embodiments, the first member 204 can be formed as a singular or unitary component. Similarly, the second member 206 can be formed as a singular or unitary component in some embodiments.

FIG. 2B shows a partially exploded view of the support 200 including the mounting block 202, the second member 206, the second knob 214, the fastener 212, and the barrel nut 208. The fastener 212 can be extendable through apertures 228, 230 formed within the second bushing 226 and the second knob 214, respectively, and engage the mounting block 202 to adjustably retain the second member 206 to the mounting block 202. For example, the fastener 212 can threadably engage a threaded aperture 232 of the mounting block 202. In some examples, two or more of the of the respective apertures 228, 230, 232 of the mounting block 202, the second member 206, and the second knob 214 can be threaded to engage the fastener 212. In some examples, the second member 206 and the second knob 214 can interlock or engage one another such that the second member 206 and the second knob 214 remain coupled even if the fastener 212 is removed from support 200. For example, the second knob 214 can include a threaded protrusion (not shown) that is received within the aperture 228 to enable the second knob 214 to rotate relative to the second member 206 yet still retain the second knob 214 to the second member 206 when the fastener 212 is removed from the support 200.

In some examples, the support 200 can include one or more detent spring assemblies (e.g., detent springs 234A, 234B, 234C, 234D). Each of the detent spring assemblies can include respective spheres or bearings biased to partially protrude from a housing by a spring element disposed within the housing. For example, the one or more detent springs 234A, 234B, 234C, 234D can be press-fit or otherwise coupled to the mounting block 202. Additionally, or alternatively, the one or more detent springs 234A, 234B, 234C, 234D can be press-fit or otherwise coupled to one or more of the first and second bushings 220, 226. The one or more detent springs 234A, 234B, 234C, 234D can form an engagement between the mounting block 202 and the first and second members 204, 206 that orient the first and second members 204, 206 relative to the mounting block 202. For example, as shown in FIG. 2B and FIG. 2C, the one or more detent springs 234A, 234B, 234C, 234D can be arranged to engage recesses 236 that correlate to particular angular positions, orientations, or configurations of the first and second members 204, 206. In other words, each of the one or more of the detent springs 234A, 234B, 234C, 234D can include a portion that extends into one of the recesses 236 to orient the member (e.g., first or second member 204,206) relative to the mounting block 202. In this manner, the first and second members 204, 206 can be angularly adjustable relative to the mounting block 202 to provide multiple configurations (see FIGS. 2D-2K) of the support 200 accommodating a plurality of use cases and use circumstances.

The recesses 236 can be arranged surrounding the aperture 228 along an arcuate path such that rotation of the second member 206 causes one or more of the recesses 236 to align with one or more of the detent springs 234A, 234B, 234C, 234D. While FIG. 2C shows the second bushing 226 as including a particular number and position of the recesses 236 (e.g., 12 recesses), the support 200 can rely on any number of recesses 236 in any position to designate discrete angular positions of the second member 206 relative to the mounting block 202. Similarly, while FIG. 2B shows a particular number and position of the detent springs 234C, 234D (e.g., two detent springs) engaging the second member 206, the support 200 can rely on any number of the detent springs in any position to designate discrete angular positions of the second member 206 relative to the mounting block 202. For example, the support 200 can have a combination of detent springs 234A, 234B, 234C, 234D and recesses 236 that enable a deployed configuration (see FIG. 2G) and a retracted configuration (see FIG. 2J) in some examples. While the recesses 236 are depicted on a surface 238 of the second bushing 226 that faces the mounting block 202, the recesses 236 can additionally, or alternatively, be disposed or formed on the mounting block 202 and one or more of the detent springs 234A, 234B, 234C, 234D can be coupled to the second bushing 226.

FIGS. 2D-2K show the support 200 in eight example configurations. Each of the eight example configurations of the support 200 shown in FIGS. 2D-2K can accommodate one or more use cases and use circumstances. For example, one or more of the configurations (see FIGS. 2G-2H) can be beneficial in standing the archery bow vertically upright (see FIGS. 1B, 1C, and 2N) on a support surface and other configurations (see FIGS. 2E-2G) may additionally, or alternatively, support the archery bow horizontally upright (see FIG. 8A) on a support surface. Additionally, or alternatively, one or more of the configurations can render the archery bow more conducive to transport or travel by retaining the one or more members 204, 206 in an orientation which does not greatly increase the side-profile of the archery bow (see FIGS. 2I-2K) and thereby enable the archery bow to be disposed within a relatively smaller carrying case.

As shown in FIG. 2L and FIG. 2M, in some examples, the support 200 can be affixed or coupled to the archery bow (e.g., archery bow 100) by a first fastener 240. For example, the first fastener 240 can be disposed within an aperture or through-hole defined by the mounting block 202. The aperture or through-hole can enable the first fastener 240 to partially extend therethrough and engage a component of the archery bow to retain the support 200 to the archery bow. In some examples, the first fastener 240 can threadably engage a stabilizer bushing or other fastening component defined by or formed within a riser (e.g., riser 102) or other component (e.g., pocket 103) of the archery bow. While the first fastener 240 is depicted in FIG. 2B as the mechanism for coupling the support 200 to the archery bow, the support 200 can be coupled to the archery bow by any mechanism including: adhering, molding, co-molding, fastening, welding, machining, interlocking, clamping, or any combination thereof.

In some examples, the support 200 can be oriented relative to the archery bow by a second fastener 242. For example, an angular position or orientation of the mounting block 202 relative to the riser of the archery bow can be maintained by an engagement between the second fastener 242 and an engaging feature 244 of the mounting block 202. The engaging feature 244 can be a groove that engages a head or other portion of the second fastener 242 and thereby prevents the mounting block 202 from rotating about the first fastener 240. While the engagement between the mounting block 202 and the archery bow is shown as a groove or cavity and the second fastener 242 in FIG. 2L and FIG. 2M, the engagement can be any structure or mechanism that controls or locks the orientation of the mounting block 202 relative to the archery bow. For example, the engagement can be any combination of one or more interlocking protrusions and cavities extending from or formed within the archery bow and the support 200.

FIG. 2N shows an archery bow 246 standing upright on a support surface 248 using the support 200. In some examples, the mounting block 202 is maintained in an orientation relative to the archery bow 246 that is conducive for reliably standing the bow upright on the support surface 248. For example, the respective points 250A, 250B at which the first and second feet 218, 224 contact the support surface 246 can define a first axis $A_2$ extending substantially parallel to the support surface 248. A second axis $A_3$ can be defined by a portion of a bow string 252 of the archery bow 246 extending between an upper cam assembly (not shown) and a lower cam assembly 254 of the archery bow 246. In some examples, a preferred or desired orientation of the mounting block 202 relative to the archery bow 246 can be achieved when the first axis $A_2$ is substantially perpendicular to the second axis $A_3$. In some examples, the an angle $\alpha_1$ formed between the first axis $A_2$ and the second axis $A_3$ can be at least about 80 degrees, between about 80 degrees and about 85 degrees, between about 85 degrees and about 90 degrees, between about 90 degrees and about 95 degrees, or between about 95 degrees and about 100 degrees.

Figure 2O:
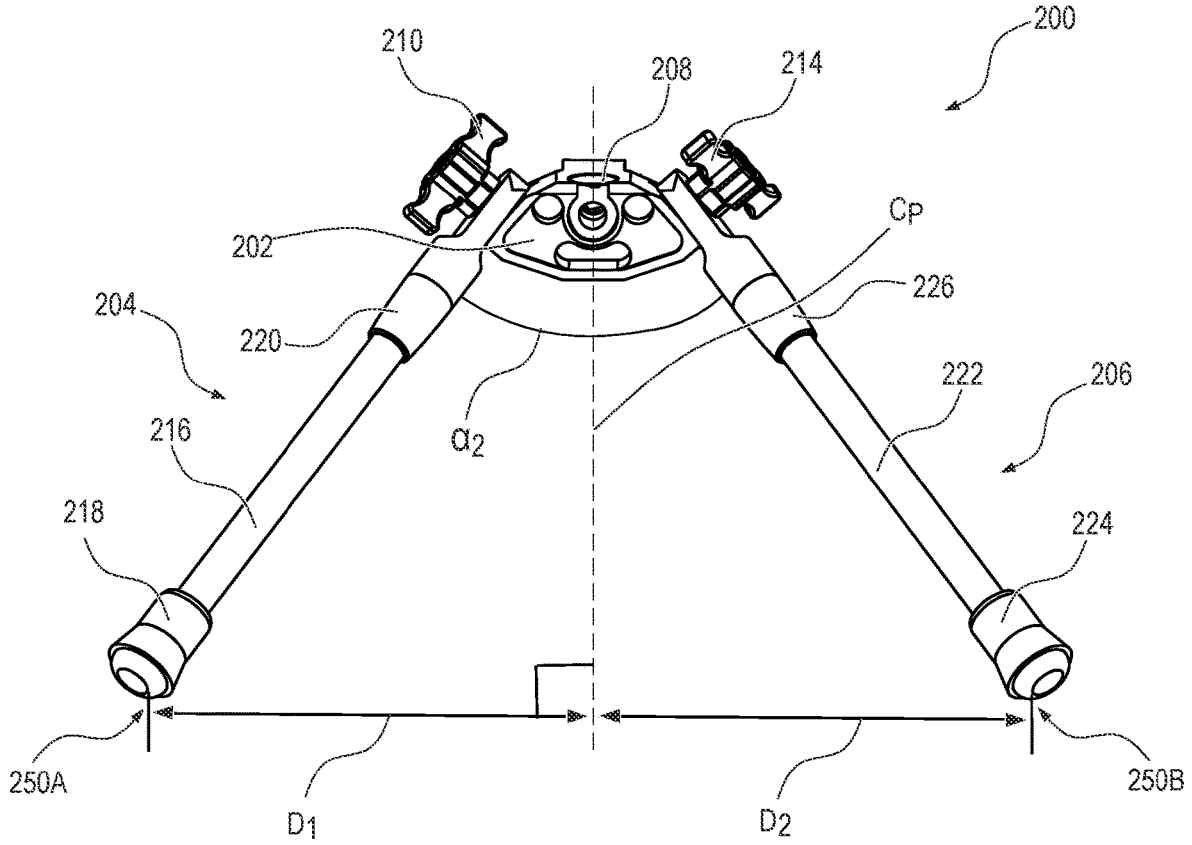
FIG. 2O is a front view the support, according to some embodiments.

FIG. 2O shows a front view of the support 200 wherein each of the respective points 250A, 250B are displaced a distance from a center plane $C_p$ of the mounting block 202. For example, the first point 250A at which the first foot 218 contacts the support surface 248 can be a first distance $D_1$ from the center plane $C_p$. The center plane $C_p$ can extend through a centroid of the mounting block 202. The first distance $D_1$ can be measured laterally from the first point 250A and extend substantially parallel to the support surface 248 and perpendicular to the center plane $C_p$. In some examples, the first distance $D_1$ can be at least about 3.75 inches, between about 3.75 inches and about 4 inches, between about 4 inches and about 4.25 inches, between about 4.25 inches and about 4.5 inches, between about 4.5 inches and about 4.75 inches, between about 4.75 inches and about 5 inches, or greater than about 5 inches.

In some examples, the second point 250B at which the second foot 224 contacts the support surface 248 can be a second distance $D_2$ from the center plane $C_p$. The second distance $D_2$ can be measured laterally from the second point 250B and extend substantially parallel to the support surface 248 and perpendicular to the center plane $C_p$. In some examples, the second distance $D_2$ can be at least about 3.75 inches, between about 3.75 inches and about 4 inches, between about 4 inches and about 4.25 inches, between about 4.25 inches and about 4.5 inches, between about 4.5 inches and about 4.75 inches, between about 4.75 inches and about 5 inches, or greater than about 5 inches. In some examples, the combined distance $D_1$, $D_2$ is at least 7.5 inches (i.e., the distance between the first and second points 250A, 250B).

In some examples, the first and second distances $D_1$, $D_2$ can correlate with an angle $\alpha_2$ defined by and extending between the first and second members 204, 206. The size of the angle $\alpha_2$ can be dependent on the respective configurations (i.e., angular position or orientation) of the first and second members 204, 206 relative to the mounting block 202. In some examples, the angle $\alpha_2$ can be less than about 20 degrees, between about 20 degrees and about 25 degrees, between about 25 degrees and about 30 degrees, between about 30 degrees and about 35 degrees, between about 35 degrees and about 40 degrees, between about 40 degrees and about 45 degrees, or greater than about 45 degrees.

Figure 2P:
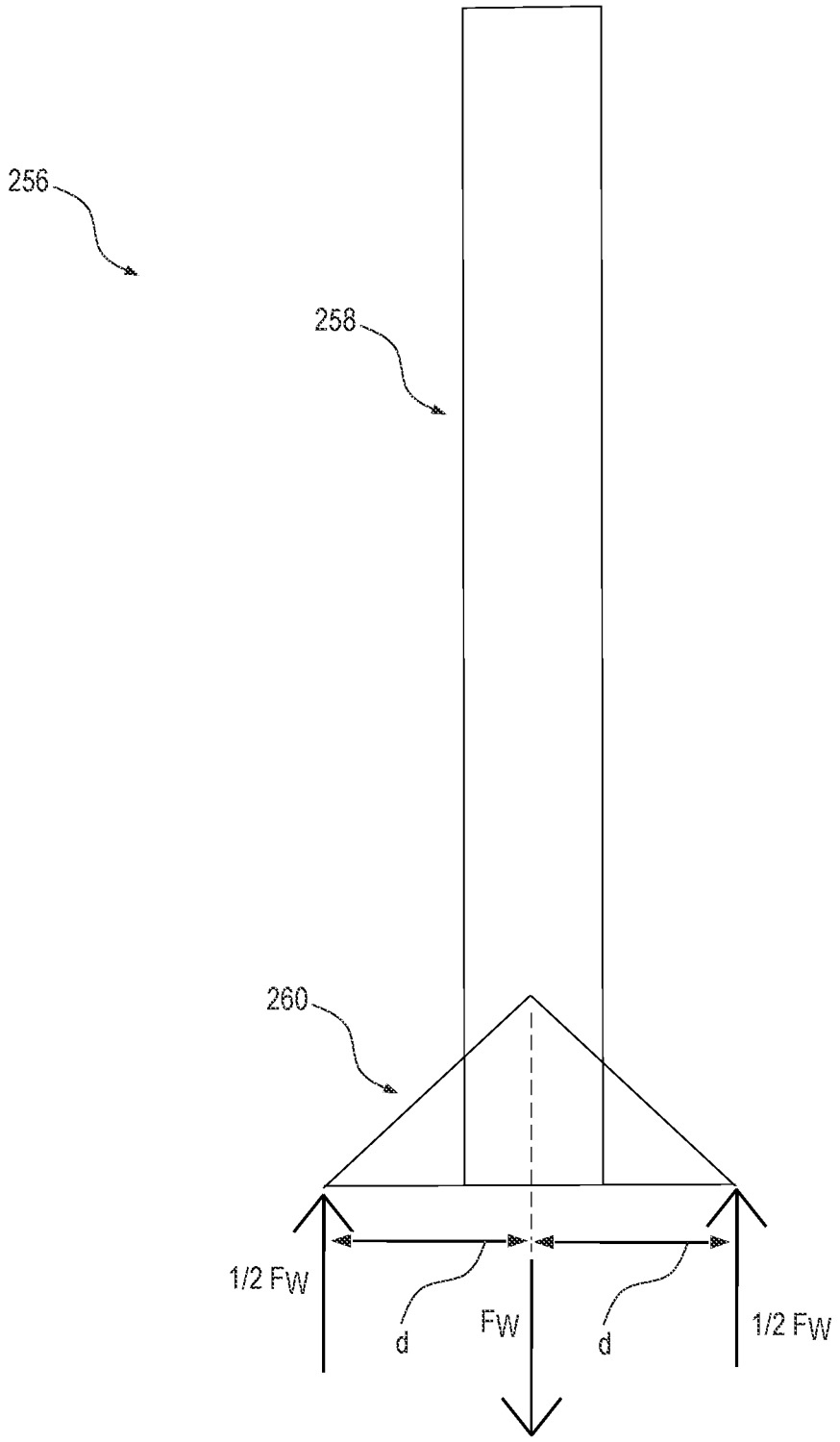
FIG. 2P is a free body diagram.
Figure 2Q:
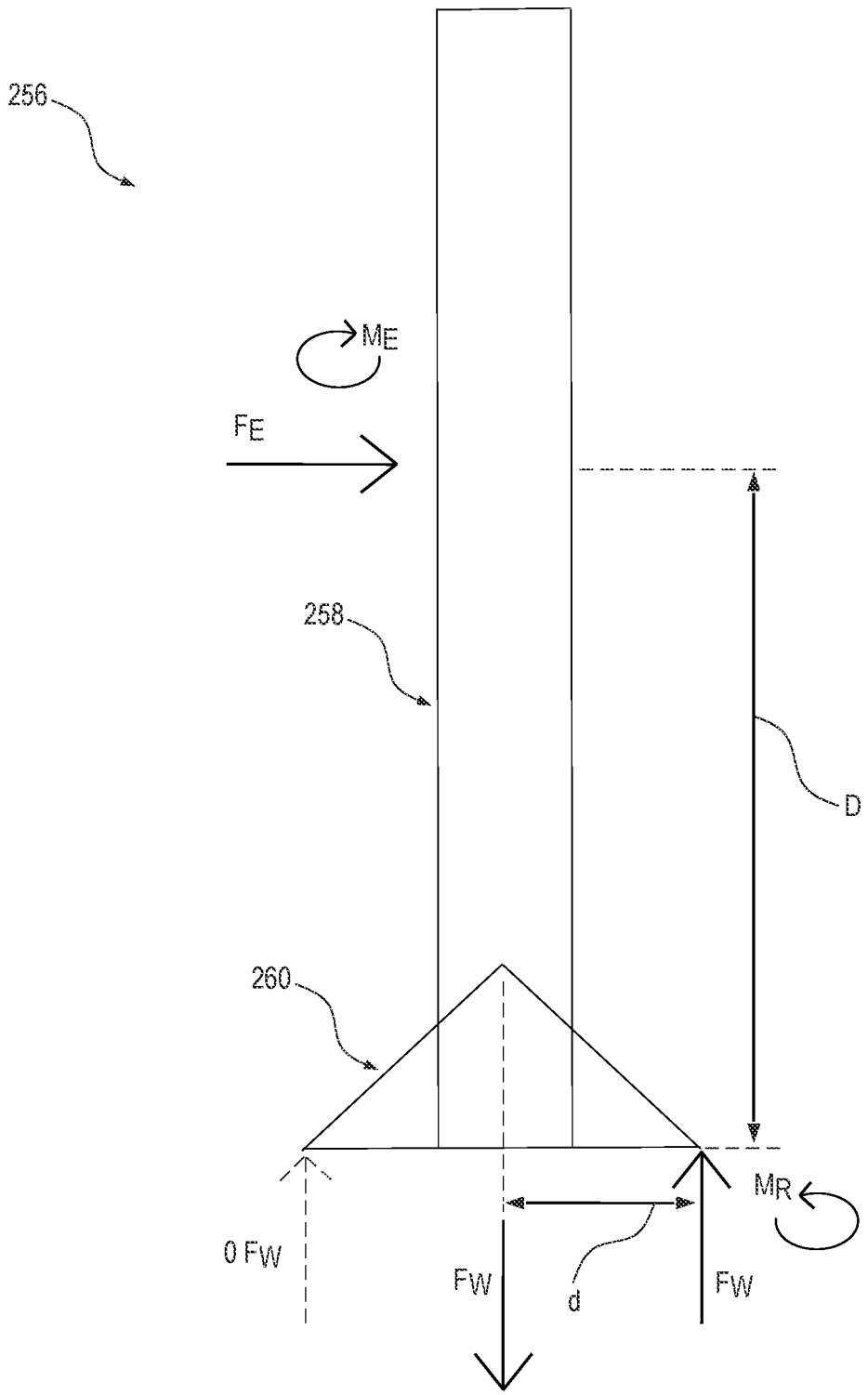
FIG. 2Q is a free body diagram.

FIG. 2P shows a free body diagram 256 including a representation of an archery bow 258 retained in a vertically upright state using a support 260. In some circumstances, as shown in FIG. 2Q, external forces can exert a moment on the archery bow 258 while resting on a support surface in a vertically or horizontally upright position. For example, while shooting archery equipment outdoors, a prevailing wind or gusting wind can exert a force on the archery bow 258 that induces a moment biasing the archery bow 258 to tip over or exit the static resting state on the support surface. While in the static or upright state, a width attributable to the support 260 and a weight of the archery bow 258 and support 260 can produce an opposing moment to retain the archery bow 258 in a static or upright state. For example, a moment of resistance $M_R$ can be generated by the product of a force $F_W$ associated with the weight of the archery bow 258 and the support 260 and a distance d associated with the location the force $F_W$ is exerted on the support 260. Conversely, a moment $M_E$ associate with the external forces can be produced by the product of a force $F_E$ associated with the external forces exerted and a distance D at which the external forces are applied (assuming even distribution of external forces over a lateral side of the archery bow 258). Equation 1, shown below, denotes the moment of resistance $M_R$ has to be at least equal to the moment $M_E$ associated with external forces in order for the archery bow 258 to remain in a vertically upright and static state (i.e., static equilibrium).

$$M_R \geq M_E \qquad \text{EQUATION 1:}$$

As denoted in Equation 1, the moment of resistance $M_R$ must be at least equivalent to the moment $M_E$ associated with external forces to enable the archery bow 258 to maintain static equilibrium on the support surface. Equation 2, shown below, represents the greatest external force $F_E$ that can be applied to the archery bow 258 before transitioning out of static equilibrium and into to a dynamic state (i.e., a tipping point). In other words, Equation 2 is representative of the moments $M_R$ and $M_E$ as their respective forces (e.g., force of the weight $F_W$ and external forces $F_E$) and distances (e.g., support 260 distance d and external force application at distance D) as the archery bow 258 approaches the tipping point. Solving for the external forces $F_E$ (see Equation 3 below), the distance d (e.g., half of a width of the support 260) acts as a multiplier to the other variables to counter or mitigate the external forces $F_E$ and therefore directly contributes to the archery bow 258 maintaining static equilibrium. In some examples, the distance d can be at least 3.75 inches to provide a minimum or threshold moment of resistance $M_R$ sufficient to oppose relatively large external forces $F_E$ exerted on the archery bow 258. In some examples, a distance d of less than 3.75 inches can be insufficient to oppose relatively large external forces $F_E$ exerted on the archery bow 258.

$$F_W*d=F_E*D \qquad \text{EQUATION 2:}$$

$$F_E = d\frac{F_W}{D} \qquad \text{EQUATION 3}$$

Figure 3A:
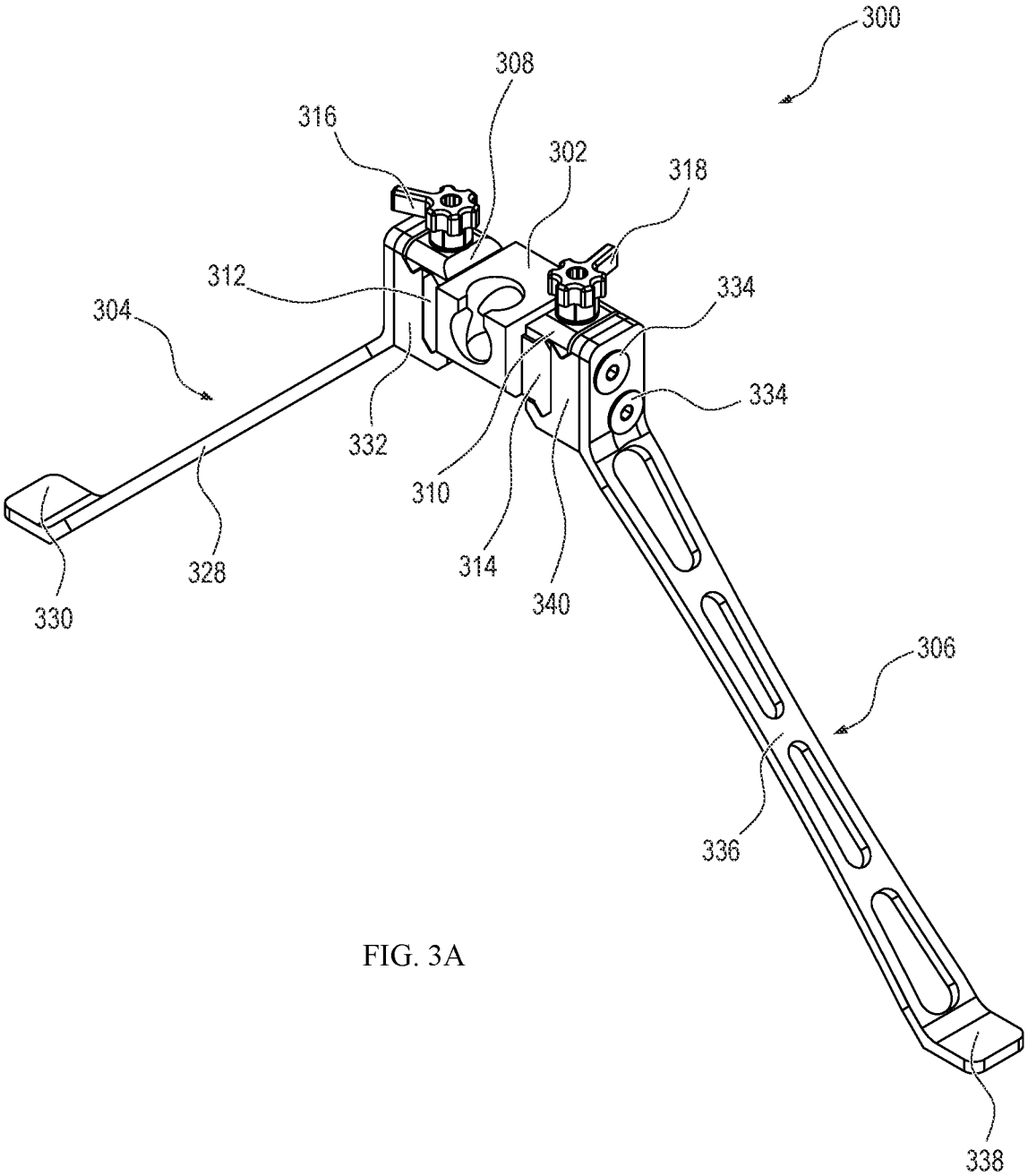
FIG. 3A is a perspective side view of a support for an archery bow, according to some embodiments.
Figure 3B:
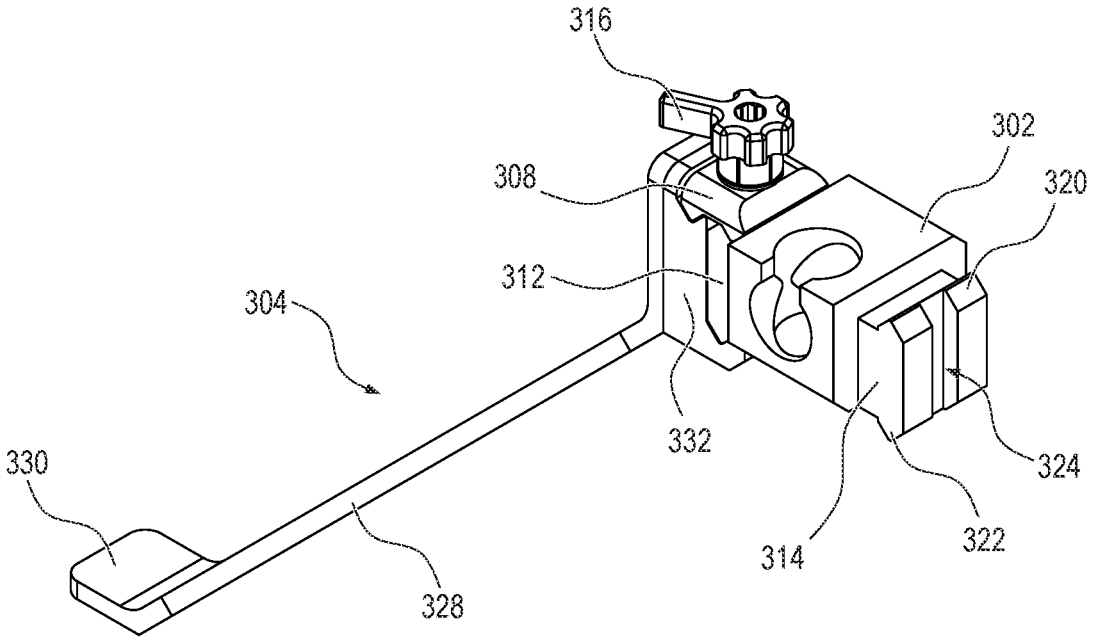
FIG. 3B is a perspective side view of the support, according to some embodiments.
Figure 3C:
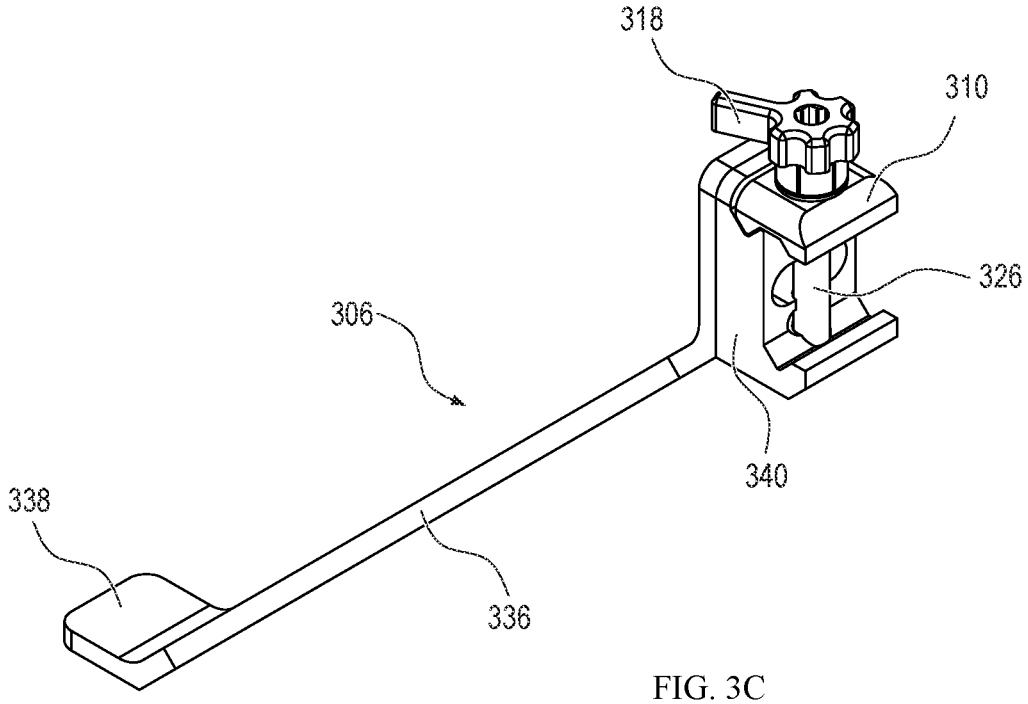
FIG. 3C is a perspective side view of a member of the support, according to some embodiments.

FIG. 3A shows a support 300 including a mounting block 302, a first member 304, and a second member 306. Each of the first and second members 304, 306 can be adjustably coupled to the mounting block 302 such that a respective position of each of the first and second members 304, 306 is linearly adjustable relative to the mounting block 302. In other words, one or more of the first and second members 304, 306 can be independently repositionable among multiple mounting positions along a dimension of the mounting block 302. Each mounting position can be considered a respective configuration of the support 300 (e.g., a first configuration, a second configuration, etc.) and each configuration can be linearly offset relative the other configurations to vary the position of the first and second members 304, 306 relative to the mounting block 302. For example, as shown in FIGS. 3A-3C, one or more of the first and second members 304, 306 can include respective interlocking features 308, 310 that are adjustably affixable at one of a plurality of mounting positions along respective rails 312, 314 or other features of the mounting block 302. In some examples, the first interlocking feature 308 can be translated in and out of engagement with the first rail 312 by rotating a first lever or knob 316. In some examples, the second interlocking feature 310 can be translated in and out of engagement with the second rail 314 by rotating a second lever or knob 318. While the engagement between the first and second interlocking features 308, 310 and the respective first and second rails 312, 314 are shown in FIGS. 3A-3C as picatinny mounting systems, the first and second members 304, 306 can be adjustably coupled to the mounting block 302 using other engagement systems, such as, dovetail engagement, fasteners, slots, grooves, sockets, threaded adjustment, camming surfaces, a combination thereof, or any other engagement system to adjustably couple the first and second members 304, 306 to the mounting block 302.

FIG. 3B shows the support 300 with the second member 306 removed to expose the second rail 314. FIG. 3C shows the second member 306. In some examples, the second rail 314 can be a picatinny rail including interlocking protrusions 320, 322 and one or more slots 324. One or more of the interlocking protrusions 320, 322 can engage the second interlocking feature 310. For example, the second knob 318 can be rotated in one direction to translate along a fastener 326 to clamp the second interlocking feature 310 onto the interlocking protrusion 320. Conversely, the second knob 318 can be rotated in another direction to translate along the fastener 326 to disengage the second interlocking feature 310 from the interlocking protrusion 320 to reposition the second member 306 along the second rail 314. The fastener 326 can be at least partially disposed within the one or more slots 324 while the second member 306 is coupled to the mounting block 302.

In some examples, the first member 304 can include a first extension 328 disposed between a first foot 330 and a first bracket 332. In some examples, the second member 306 can include a second extension 336 disposed between a second foot 338 and a second bracket 340. In some examples, the first foot 330 can be integrally formed with the first extension 328. Similarly, the second foot 338 can be integrally formed with the second extension 336. In some examples, the first bracket 332 can be integrally formed with the first extension 328. Similarly, the second bracket 340 can be integrally formed with the second extension 336. In other examples, as shown in FIGS. 3A-3C, the first bracket 332 and/or the second bracket 340 can be fastened or otherwise coupled to the first extension 328 or the second extension 336 by one or more fasteners 334, respectively.

Figure 4A:
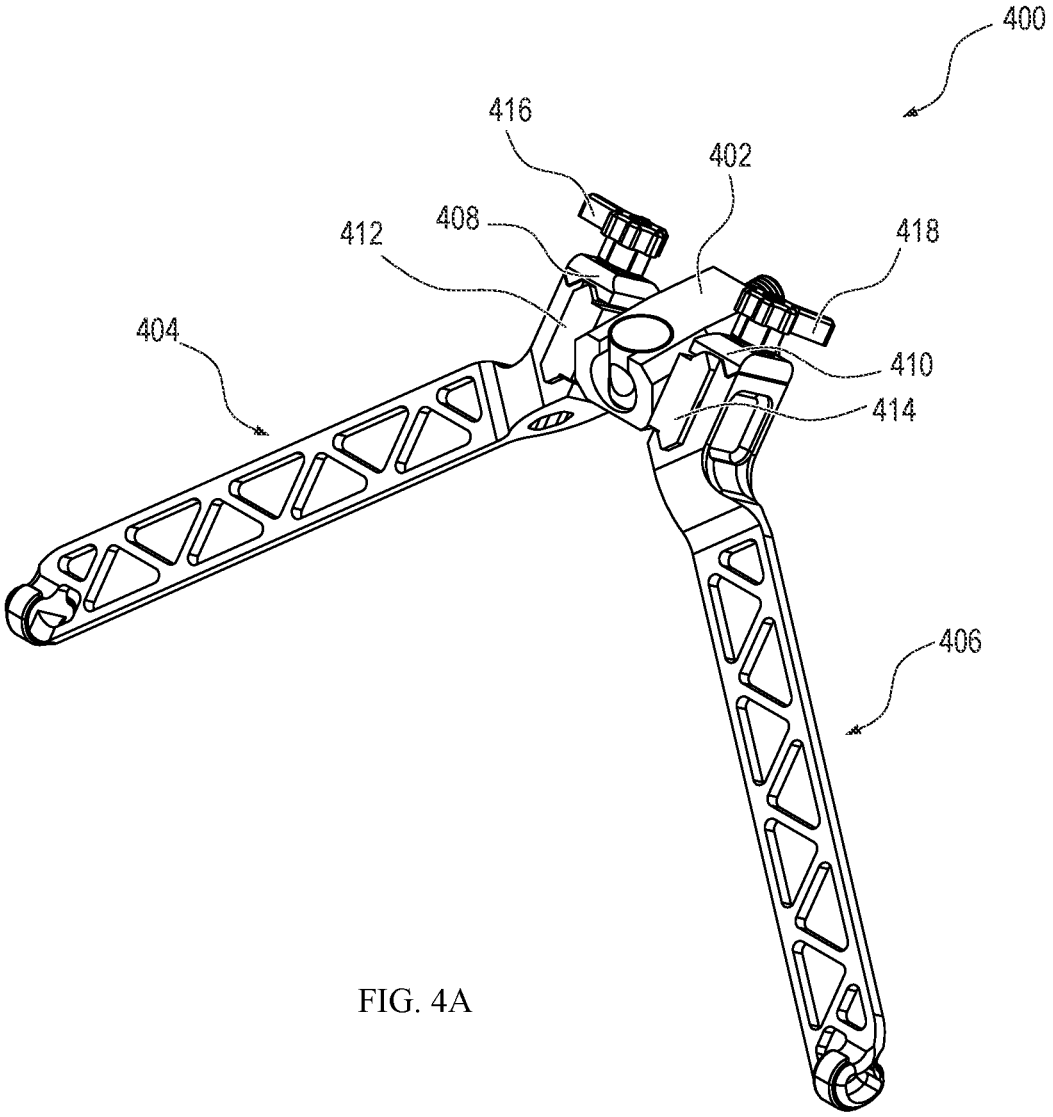
FIG. 4A is a perspective side view of a support for an archery bow, according to some embodiments.
Figure 4B:
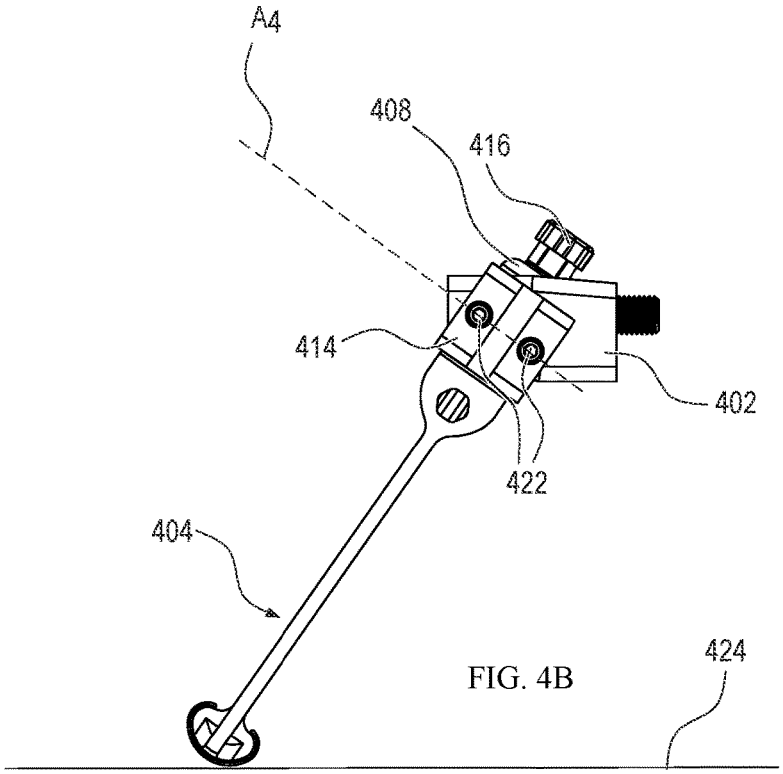
FIG. 4B is a perspective side view of the support, according to some embodiments.
Figure 4C:
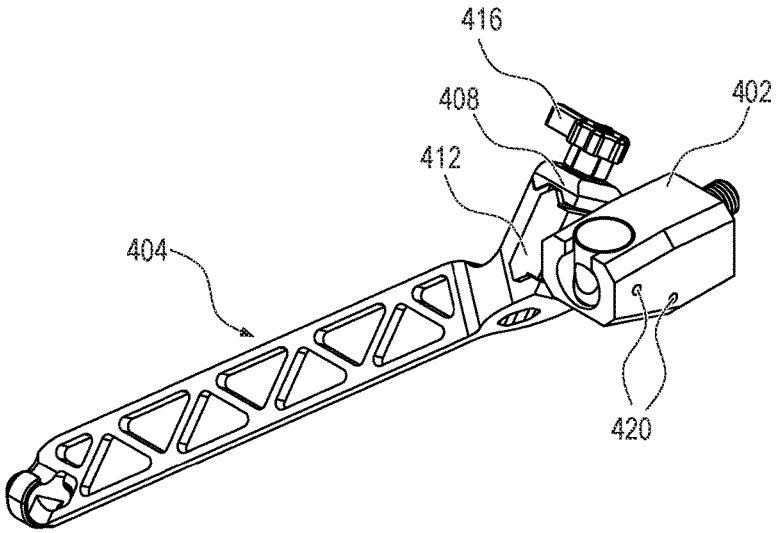
FIG. 4C is a perspective side view of the support, according to some embodiments.

FIG. 4A shows a support 400 including a mounting block 402, a first member 404, and a second member 406. Each of the first and second members 404, 406 can be adjustably coupled to the mounting block 402 such that a respective position of each of the first and second members 404, 406 is linearly adjustable relative to the mounting block 402. In other words, one or more of the first and second members 404, 406 can be independently repositionable among multiple mounting positions along a dimension of the mounting block 402. For example, as shown in FIGS. 4A-4C, one or more of the first and second members 404, 406 can include respective interlocking features 408, 410 that are adjustably affixable at one of a plurality of mounting positions along respective rails 412, 414 or other features of the mounting block 402.

In some examples, the first interlocking feature 408 can be translated in and out of engagement with the first rail 412 by rotating a first lever or knob 416. In some examples, the second interlocking feature 410 can be translated in and out of engagement with the second rail 414 by rotating a second lever or knob 418. While the engagement between the first and second interlocking features 408, 410 and the respective first and second rails 412, 414 are shown in FIGS. 4A-4C as picatinny mounting systems, the first and second members 404, 406 can be adjustably coupled to the mounting block 402 using other engagement systems, such as, dovetail engagement, fasteners, slots, grooves, sockets, threaded adjustment, camming surfaces, a combination thereof, or any other engagement system to adjustably couple the first and second members 404, 406 to the mounting block 402.

In some examples, an engagement between the first and second interlocking features 408, 410 and the first and second rails 412, 414 can be substantially similar to the engagement described above with reference to FIGS. 3A-3C relating to the first and second interlocking features 308, 310 and the first and second rails 312, 314. For example, the first and second members 404, 406 can be affixed to the first and second rails 412, 414 via a clamping mechanism using a fastener and interlocking protrusions. In some examples, each of the first and second rails 412, 414 can be removable from the mounting block 402. For example, the mounting block 402 can include threaded apertures 420 and each of the first and second rails 412, 414 can be removably coupled to the mounting block 402 by one or more fasteners 422 receivable within the one or more threaded apertures 420.

In some examples, linear mounting positions defined by each respective rail 412, 414 can be disposed along respective axes (e.g., mounting position axis $A_4$). An orientation of the mounting position axis $A_4$ relative to the mounting block 402 can be any orientation desirably orienting the mounting positions relative to a support surface 424. For example, the second rail 414 can be oriented relative to the mounting block 402 such that the mounting position axis $A_4$ extends non-parallel to the support surface 424 when the support 400 and archery bow are placed upright on the support surface 424. In other words, the mounting positions defined by the second rail 414 and along the mounting position axis $A_4$ are all different distances from the support surface 424 such that a user can vary the stance (e.g., the orientation of the riser relative to the support surface 424) of the archery bow on the support surface 424 by effectively lengthening or shortening the first and second member 404, 406 by repositioning the first and second members 404, 406 along the mounting position axis $A_4$. Alternatively, the second rail 414 can be oriented relative to the mounting block 402 such that the mounting position axis $A_4$ extends parallel to the support surface 424 when the support 400 and archery bow are placed upright on the support surface 424. In other words, the mounting positions defined by the second rail 414 and along the mounting position axis $A_4$ are all the same distance from the support surface 424 thus repositioning the first and second members 404, 406 along the mounting position axis $A_4$ may not vary the stance of the archery bow on the support surface 424.

Figure 5A:
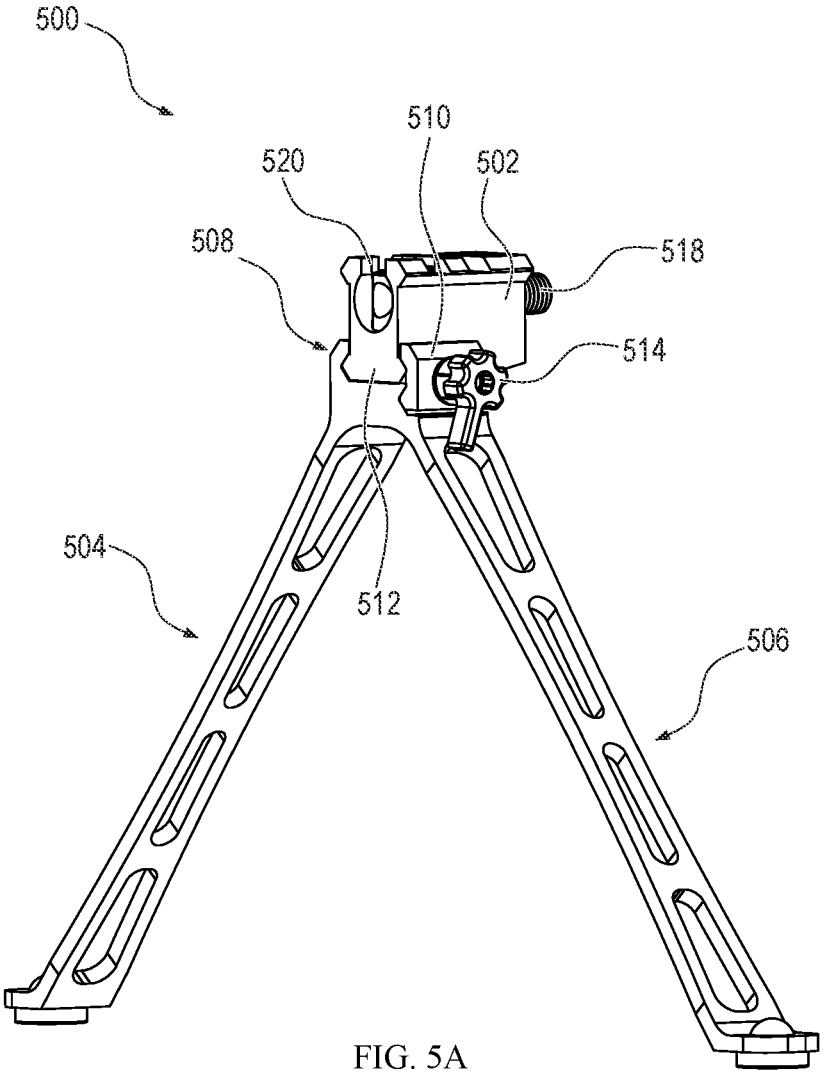
FIG. 5A is a perspective side view of a support for an archery bow, according to some embodiments.
Figure 5B:
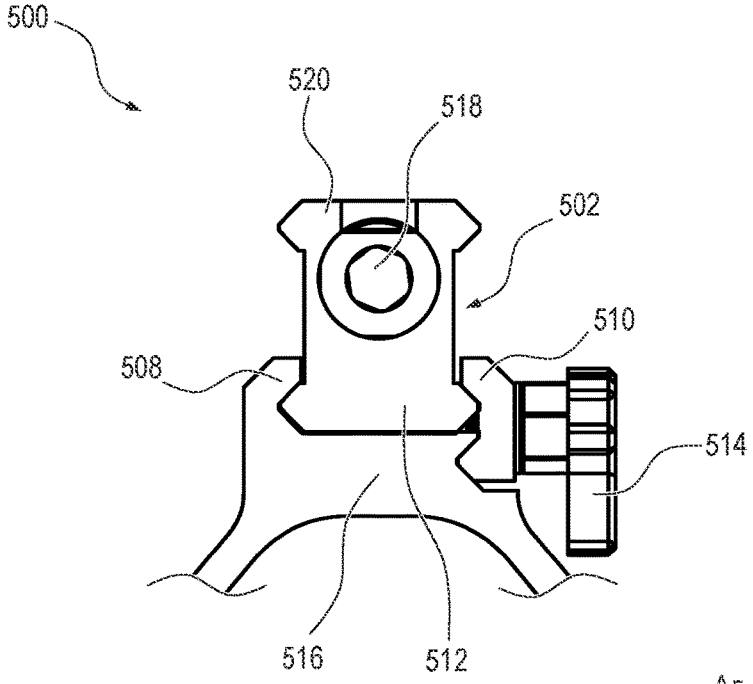
FIG. 5B is a front detail view of the support, according to some embodiments.
Figure 5C:
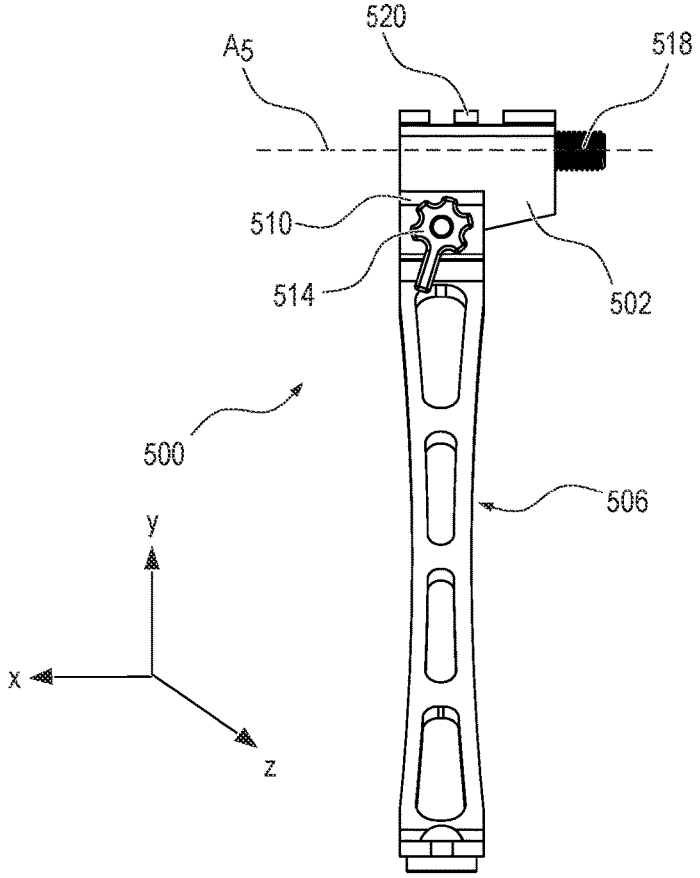
FIG. 5C is a side view of the support, according to some embodiments.

FIG. 5A shows an example of a support 500 for an archery bow. The support 500 includes a mounting block 502, a first member 504, and a second member 506. Each of the first and second members 504, 506 can be adjustably coupled to the mounting block 502 such that a position of the first and second members 504, 506 is linearly adjustable relative to the mounting block 502. In other words, the first and second members 504, 506 can be repositionable at one of multiple mounting positions disposed along a dimension of the mounting block 502. For example, as shown in FIGS. 5A-5C, the first and second members 504, 506 can be a singular or unitary structure including a first interlocking feature 508. In some examples, the combination of the first interlocking feature 508 and a second interlocking feature 510 can engage a rail 512 defined or formed by the mounting block 502 to adjustably affix the first and second members 504, 506 at one of a plurality of mounting positions along the rail 512.

In some examples, the second interlocking feature 510 can be translated in and out of engagement with the rail 512 by rotating a lever or knob 514. While the engagement between the first and second interlocking features 508, 510 and the rail 512 is shown in FIGS. 5A-5C as a picatinny mounting system, the first and second members 504, 506 can be adjustably coupled to the mounting block 502 using another engagement system, such as, dovetail engagement, fasteners, slots, grooves, sockets, threaded adjustment, camming surfaces, a combination thereof, or any other engagement system to adjustably couple the first and second members 504, 506 to the mounting block 502. In some examples, the first and second members 504, 506 can be integrally formed such that the first and second members 504, 506 are intercoupled by an intermediate portion 516. In other examples, each of the first and second members 504, 506 can be fastened or otherwise removably coupled to the intermediate portion 516.

In some examples, the first and second members 504, 506 and the intermediate portion 516 can be a singular structure capable of being repositioned along the rail 512 as a singular component. That is, the orientation and positional relationship between the first and second members 504, 506 can be constant as the first and second members 504, 506 are repositioned along the rail 512. As shown in FIG. 5C, in some examples, the first and second members 504, 506 can extend substantially perpendicular from the mounting block 502. In other words, the first and second members 504, 506 can extend from the mounting block 502 at an orientation that is perpendicular to an axis $A_5$ defined by a fastener 518 extending through the mounting block 502 to couple the support 500 to an archery bow. In some examples, the axis $A_5$ can additionally, or alternatively, be defined as parallel to a shooting axis of the archery bow (i.e., an axis $A_S$ the arrow is mounted within the archery bow and travels as the arrow is launched from the archery bow, see FIG. 1A). In some examples, the axis $A_5$ can additionally, or alternatively, be defined as extending downrange and away from the archery bow (e.g., extending in the x-direction defined by the coordinate system shown in FIG. 5C). The first and second members 504, 506 can be repositionable along the rail 512 which extends in the same direction (e.g., x-direction) as the axis $A_5$.

In some examples, the mounting block 502 can define a second rail 520. For example, as shown in FIGS. 5A-5C, the second rail 520 can be disposed on an opposite side of the mounting block 502 than the rail 512 such as an upper rail (e.g., second rail 520) and a lower rail (e.g., rail 512). In some examples, the first and second members 504, 506 can be repositionably coupled along the second rail 520. In some examples, one or more accessories can be removably coupled to the second rail 520, such as, one or more flashlights, cameras, stabilizers, electronic measurement devices (e.g., accelerometers), gyroscopes, quivers, storage compartments, lasers, mounts, other accessories, or combinations thereof.

Figure 6A:
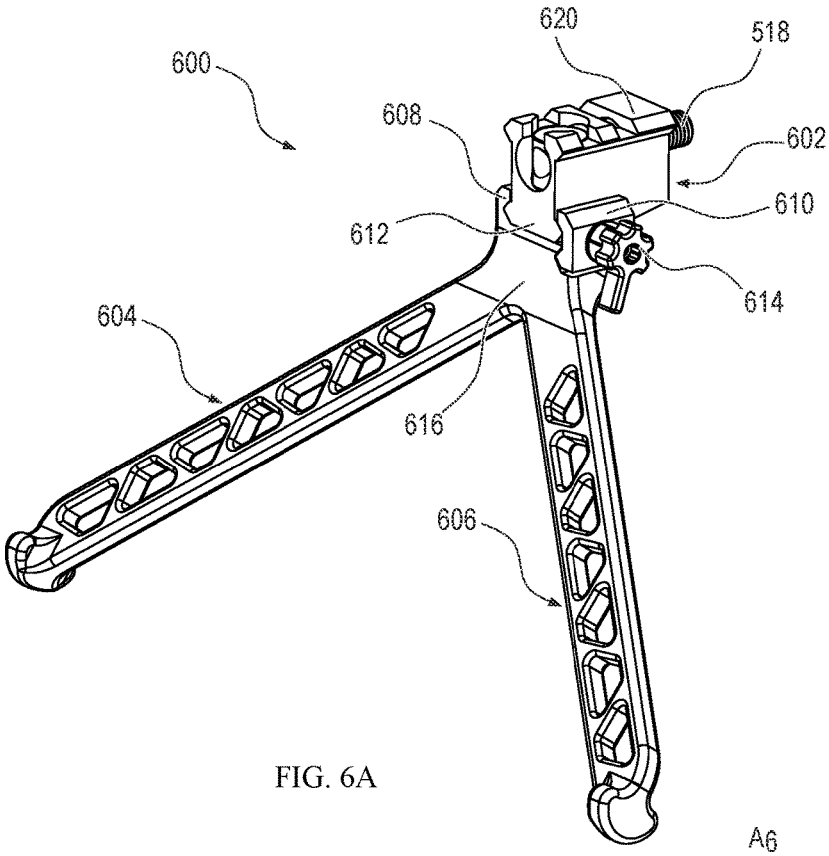
FIG. 6A is a perspective side view of a support for an archery bow, according to some embodiments.
Figure 6B:
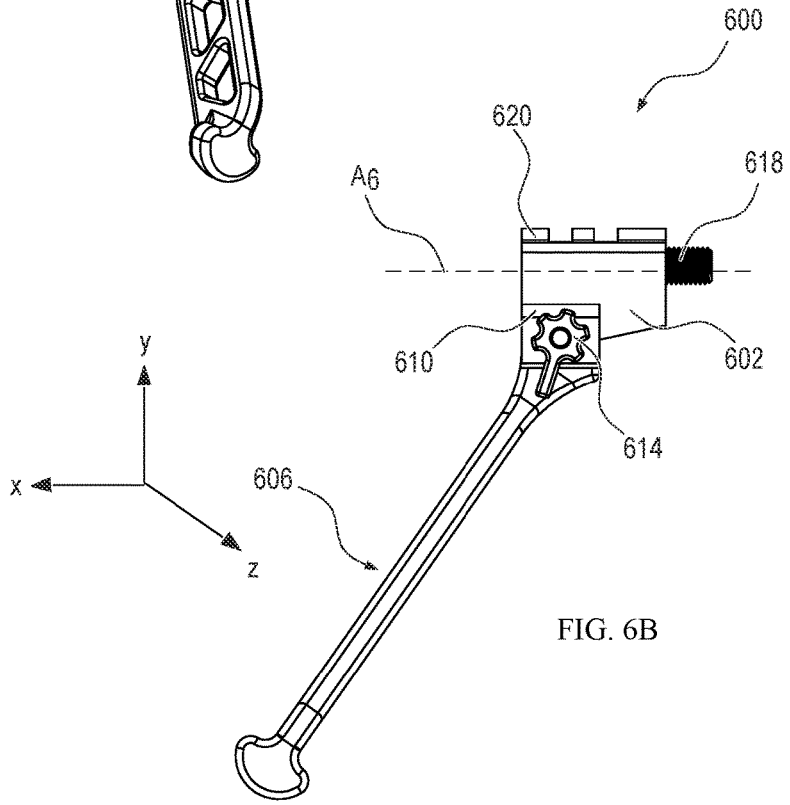
FIG. 6B is a side view of the support, according to some embodiments.

FIG. 6A shows a support 600 including a mounting block 602, a first member 604, and a second member 606. Each of the first and second members 604, 606 can be adjustably coupled to the mounting block 602 such that a position of the first and second members 604, 606 is linearly adjustable relative to the mounting block 602. In other words, the first and second members 604, 606 can be repositionable at one of multiple mounting positions disposed along a dimension of the mounting block 602. For example, as shown in FIG. 6A and FIG. 6B, the first and second members 604, 606 can be a singular or unitary structure including a first interlocking feature 608. In some examples, the combination of the first interlocking feature 608 and a second interlocking feature 610 can engage a rail 612 defined or formed by the mounting block 602 to adjustably affix the first and second members 604, 606 at one of a plurality of mounting positions along the rail 612.

In some examples, the second interlocking feature 610 can be translated in and out of engagement with the rail 612 by rotating a lever or knob 614. While the engagement between the first and second interlocking features 608, 610 and the rail 612 is shown in FIG. 6A and FIG. 6B as a picatinny mounting system, the first and second members 604, 606 can be adjustably coupled to the mounting block 602 using another engagement system, such as, dovetail engagement, fasteners, slots, grooves, sockets, threaded adjustment, camming surfaces, a combination thereof, or any other engagement system to adjustably couple the first and second members 604, 606 to the mounting block 602. In some examples, the first and second members 604, 606 can be integrally formed such that the first and second members 604, 606 are intercoupled by an intermediate portion 616. In other examples, each of the first and second members 604, 606 can be fastened or otherwise removably coupled to the intermediate portion 616.

In some examples, the first and second members 604, 606 and the intermediate portion 616 can be a singular structure capable of being repositioned along the rail 612 as a singular component. That is, the orientation and positional relationship between the first and second members 604, 606 can be constant as the first and second members 604, 606 are repositioned along the rail 612. As shown in FIG. 6B, in some examples, the first and second members 604, 606 can extend at an angle (i.e., non-perpendicular) from the mounting block 602. In other words, the first and second members 604, 606 can extend from the mounting block 602 at an orientation that is not perpendicular to an axis $A_6$ defined by a fastener 618 extending through the mounting block 602 to couple the support 600 to an archery bow. In some examples, the axis $A_6$ can additionally, or alternatively, be defined as parallel to a shooting axis of the archery bow (i.e., the axis $A_S$ the arrow is mounted within the archery bow and travels as the arrow is launched from the archery bow, see FIG. 1A). In some examples, the axis $A_6$ can additionally, or alternatively, be defined as extending downrange and away from the archery bow (e.g., extending in the x-direction defined by the coordinate system shown in FIG. 6B). The first and second members 604, 606 can be repositionable along the rail 612 which extends in the same direction (e.g., x-direction) as the axis $A_6$.

In some examples, the mounting block 602 can define a second rail 620. For example, as shown in FIG. 6A and FIG. 6B, the second rail 620 can be disposed on an opposite side of the mounting block 602 than the rail 612 such as an upper rail (e.g., second rail 620) and a lower rail (e.g., rail 612). In some examples, the first and second members 604, 606 can be repositionably coupled along the second rail 620. In some examples, one or more accessories can be removably coupled to the second rail 620, such as, one or more flashlights, cameras, stabilizers, electronic measurement devices (e.g., accelerometers), gyroscopes, quivers, storage compartments, lasers, mounts, other accessories, or combinations thereof.

Figure 7:
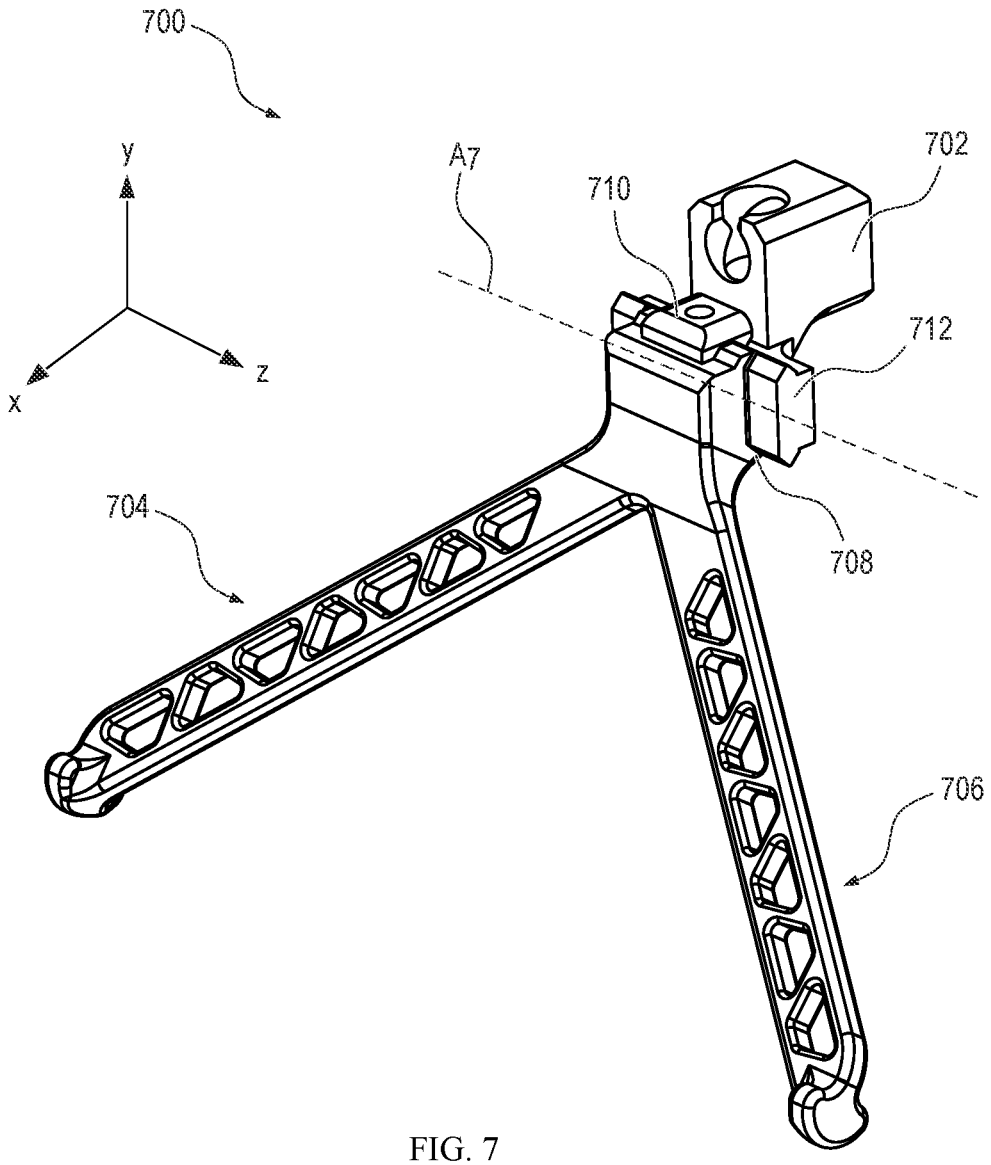
FIG. 7 shows a perspective side view of a support, according to some embodiments.

FIG. 7 shows a support 700 including a mounting block 702, a first member 704, and a second member 706. Each of the first and second members 704, 706 can be adjustably coupled to the mounting block 702 such that a position of the first and second members 704, 706 is linearly adjustable relative to the mounting block 702. In other words, the first and second members 704, 706 can be repositionable at one of multiple mounting positions disposed along a dimension of the mounting block 702. For example, as shown in FIG. 7, the first and second members 704, 706 can be a singular or unitary structure including a first interlocking feature 708. In some examples, the combination of the first interlocking feature 708 and a second interlocking feature 710 can engage a rail 712 defined or formed by the mounting block 702 to adjustably affix the first and second members 704, 706 at one of a plurality of mounting positions along the rail 712.

In some examples, the first and second members 704, 706 can be a singular structure capable of being repositioned along the rail 712 as a singular component. That is, the orientation and positional relationship between the first and second members 704, 706 can be constant as the first and second members 704, 706 are repositioned along the rail 712. As shown in FIG. 7, in some examples, the first and second members 704, 706 can be repositionable relative to the mounting block 702 along the rail 712 (e.g., an axis $A_7$) such that the first and second members 704, 706 are moved laterally or sidewards (e.g., extending in the z-direction defined by the coordinate system shown in FIG. 7). In some examples, the axis $A_7$ can be defined as orthogonal to a shooting plane defined by the shooting axis of the archery bow (i.e., the axis $A_S$, see FIG. 1A). As such, the axis $A_7$ can be defined as extending substantially lateral to and away from the support 700.

Figure 8A:
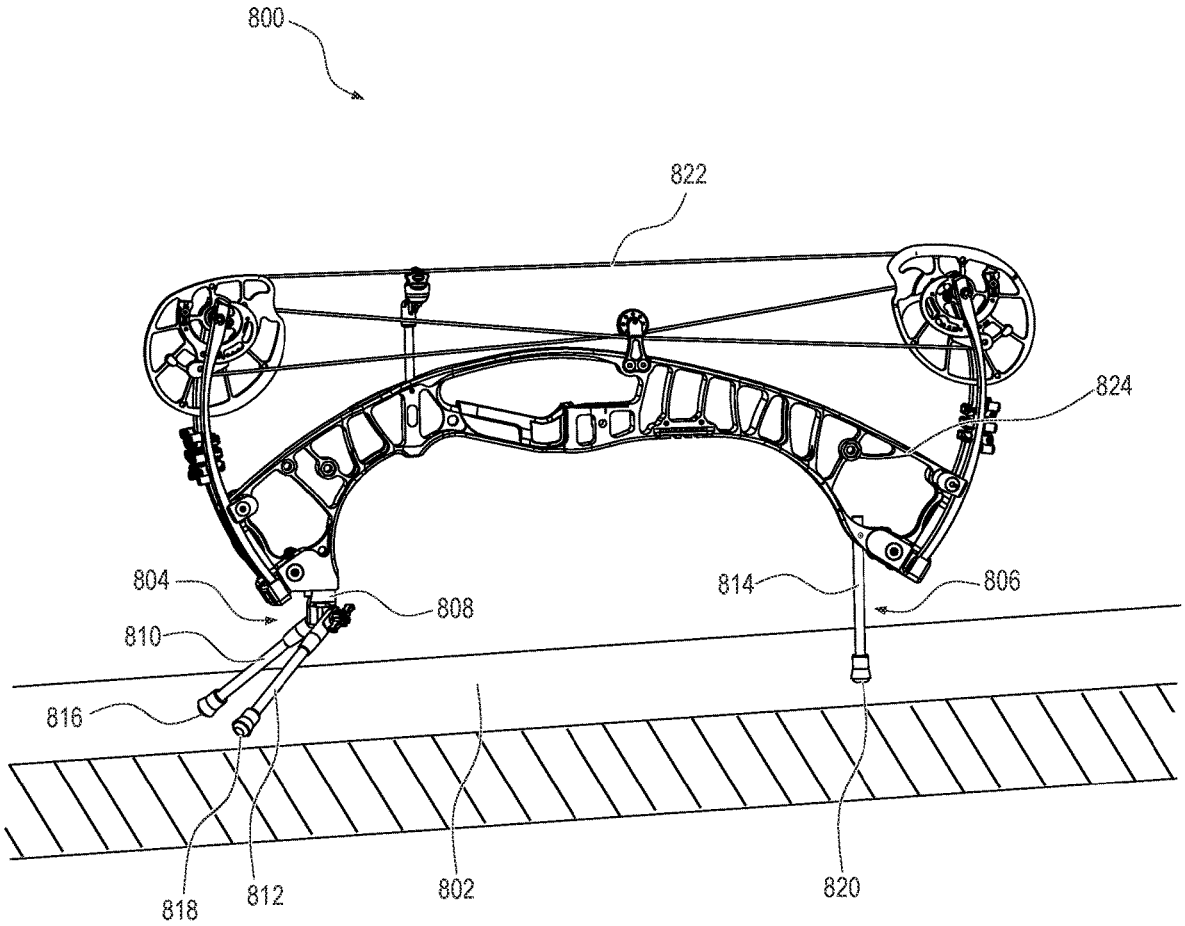
FIG. 8A is a perspective side view of an archery bow on a support surface, according to some embodiments.

FIG. 8A shows an archery bow 800 placed horizontally upright on a support surface 802 using a first support 804 and a second support 806. The first support 804 can be substantially similar to, and can include some or all of, the features of the supports 126, 200, 300, 400, 500, 600, 700. For example, the first support 804 can include a mounting block 808, a first member 810, and a second member 812. Each of the first and second members 810, 812 can be adjustable relative to the mounting block 808 as described herein with reference to FIGS. 1A-7. In some examples, the second support 806 can include a third member 814 extending from the archery bow 800 and contacting the support surface 802. For example, the first support 804 can define or form one or more contact points 816, 818 and the second support 806 can define or form one or more contact points 820 to support the bow in a static and upright position on the support surface 802. While the second support 806 is shown as including a solitary member 820, the second support 806 can include more than one member in other examples. For example, like the first support 804, the second support 806 can include a mounting block and two or more members in some examples.

The members 810, 812, 814 of the first and second supports 804, 806 can be adjusted, configured, or otherwise oriented such that a bow string 822 of the archery bow 800 extends substantially parallel to the support surface 802 while the archery bow 800 is being supported on the support surface 802. In some examples, the length of each member 810, 812, 814 can be individually or collectively adjusted (e.g., lengthened or shortened) to accommodate the geometry of the archery bow and any other accessories that may be protruding from the archery bow (e.g., a sight, a stabilizer, a quiver, etc.).

Figure 8B:
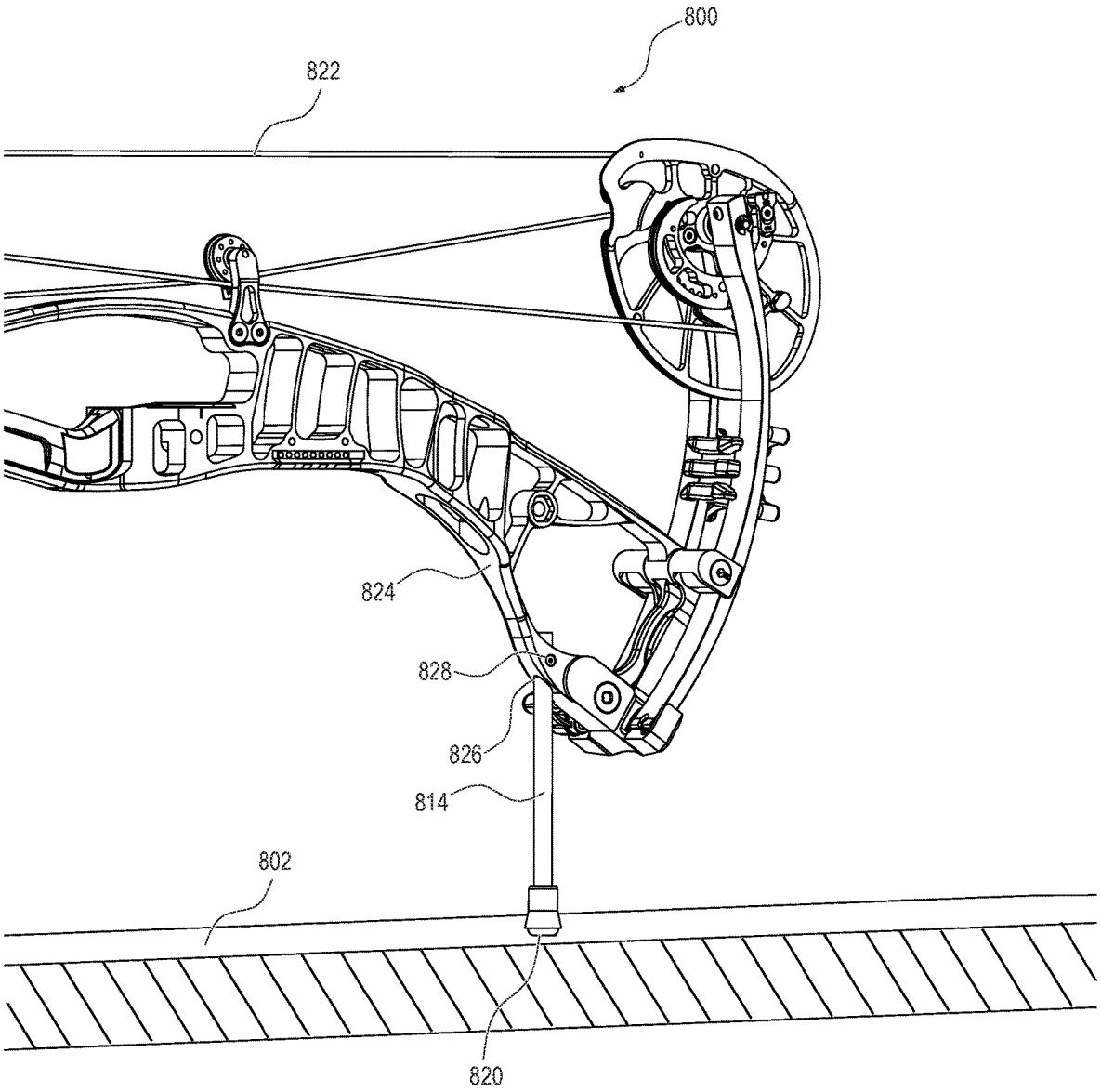
FIG. 8B is a detail side view of the archery bow on the support surface, according to some embodiments.

FIG. 8B shows a detailed view of the second support 806 coupled to a riser 824 of the archery bow 800. In some examples, the second support 806 can be received within an aperture or cavity 826 defined by the riser 824 and held in place by one or more fasteners (e.g., a set screw 828). As such, a length from which the second support 806 extends from the riser 824 can be adjusted by loosening the set screw 828, translating the second support 806 within the aperture 826, and tightening the set screw 828. While the second support 806 is shown in FIGS. 8A and 8B as coupled to the riser 824 of the archery bow 800, the second support 806 can be coupled to any component of the archery bow 800.

In some examples, changes may be made in the function and arrangement of archery components or products discussed without departing from the spirit and scope of the disclosure, and various embodiments may omit, substitute, or add other components or accessories as appropriate. For instance, one or more portions incorporated into a particular component described with respect to certain embodiments may be combined in other embodiments.

Various aspects have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including:" and "having" come as used in the specification and claims shall have the same meaning as the term "comprising."

What is claimed:

1. An archery bow and support, the archery bow comprising:

a riser;

a first limb coupled to a first end of the riser;

a second limb coupled to a second end of the riser;

a first cam coupled to the first limb;

a second cam coupled to the second limb; and a bowstring extending between the first cam and the second cam, the archery bow defining a periphery;

the support comprising:

a mounting block; and a member having a proximal end and a distal end, the proximal end coupled to the mounting block, the member being repositionable between two or more configurations relative to the mounting block, the member configured to contact a support surface in a first configuration, wherein:

in the first configuration, the distal end is disposed outside of the periphery; and in a second configuration, the distal end is disposed inside the periphery.

2. The archery bow and support of claim 1, wherein the member includes an extension having a bushing and a foot coupled to opposing ends of the extension.

3. The archery bow and support of claim 2, wherein:

the extension is wholly disposed outside the periphery in the first configuration; and the extension is wholly disposed inside the periphery in the second configuration.

* * * * *